US005733825A

United States Patent [19]

Martin et al.

[11] Patent Number: 5,733,825

[45] Date of Patent: Mar. 31, 1998

[54] UNDRAWN TOUGH DURABLY MELT-BONDABLE MACRODENIER THERMOPLASTIC MULTICOMPONENT FILAMENTS

[75] Inventors: Philip G. Martin, Forest Lake; Gary L. Olson; Dennis G. Welygan, both of Woodbury, all of Minn.

[73] Assignee: Minnesota Mining and Manufacturing Company, St. Paul, Minn.

[21] Appl. No.: 757,390

[22] Filed: Nov. 27, 1996

[51] Int. Cl.[6] ..... D02G 3/00

[52] U.S. Cl. ..... 442/361; 51/295; 156/209; 156/244.12; 264/173.16; 428/372; 428/373; 428/374; 442/364; 442/398

[58] Field of Search ..... 428/372, 373, 428/374; 442/361, 364, 398; 51/297, 295; 156/209, 244.12; 264/173.16

[56] References Cited

U.S. PATENT DOCUMENTS

| | | |
|---|---|---|
| 2,958,593 | 11/1960 | Hoover et al. . |
| 3,562,356 | 2/1971 | Nyberg et al. . |
| 3,589,956 | 6/1971 | Kranz et al. . |
| 3,686,049 | 8/1972 | Manner . |
| 3,687,759 | 8/1972 | Werner . |
| 3,691,004 | 9/1972 | Werner . |
| 3,707,341 | 12/1972 | Fontijn et al. . |
| 3,792,124 | 2/1974 | Davison et al. . |
| 3,837,988 | 9/1974 | Hennen et al. . |
| 4,052,146 | 10/1977 | Sternberg . |
| 4,189,338 | 2/1980 | Ejima et al. . |
| 4,211,819 | 7/1980 | Kunimune et al. . |
| 4,227,350 | 10/1980 | Fitzer . |
| 4,234,655 | 11/1980 | Kunimune et al. . |
| 4,251,200 | 2/1981 | Parkin . |
| 4,252,590 | 2/1981 | Rasen et al. . |
| 4,269,888 | 5/1981 | Ejima et al. . |
| 4,351,683 | 9/1982 | Kusilek . |

(List continued on next page.)

FOREIGN PATENT DOCUMENTS

| | | |
|---|---|---|
| 0586937 A1 | 8/1993 | European Pat. Off. . |
| 3-158236 | 7/1991 | Japan . |
| 6-49256 | 2/1994 | Japan . |
| 6-279742 | 10/1994 | Japan . |
| 8-27444 | 1/1996 | Japan . |
| 1095166 | 12/1967 | United Kingdom . |
| 1 451 607 | 10/1976 | United Kingdom . |
| WO 89/02938 | 4/1989 | WIPO . |
| WO 96/37644 | 11/1996 | WIPO . |

OTHER PUBLICATIONS

ASTM D882–90, STM for Tensil Properties of Thin Plastic Sheeting, pp. 315–323, dated Dec. 1990.

ASTM D2859–76, STM for Flammability of Finished Textile Floor Covering Materials, pp. 502–504.

Polymer Blends and Alloys, Blackie Academic & Professional, 1993, p. 143.

AT 1841 Eva Copolymer Product Information, AT Plastics, Inc. not dated.

Product Data for Vista Flex 641–N, Advanced Elastomer Systems, 1991.

(List continued on next page.)

*Primary Examiner*—James J. Bell

*Attorney, Agent, or Firm*—Gary L. Griswold; Walter N. Kirn; Daniel R. Pastirik

[57] ABSTRACT

Undrawn, tough, durably melt-bondable, macrodenier, thermoplastic, multicomponent filaments, such as sheath-core and side-by-side filaments, comprising a first plastic component and a second lower-melting component defining all or at least part of the material-air boundary of the filaments. The filaments can be made by melt-extruding thermoplastics to form hot filaments, cooling and solidifying the hot filaments, and recovering the solidified filaments without any substantial tension being placed thereon. Aggregations of the filaments can be made in the form of floor matting and abrasive articles.

42 Claims, 5 Drawing Sheets

U.S. PATENT DOCUMENTS

| | | | |
|---|---|---|---|
| 4,379,806 | 4/1983 | Korpman . | |
| 4,384,022 | 5/1983 | Fowler . | |
| 4,406,850 | 9/1983 | Hills . | |
| 4,460,364 | 7/1984 | Chen et al. . | |
| 4,469,540 | 9/1984 | Furukawa et al. . | |
| 4,500,384 | 2/1985 | Tomioka et al. . | |
| 4,552,603 | 11/1985 | Harris, Jr. et al. . | |
| 4,631,215 | 12/1986 | Welygan et al. . | |
| 4,634,485 | 1/1987 | Welygan et al. . | |
| 4,663,220 | 5/1987 | Wisneski et al. | 428/221 |
| 4,704,110 | 11/1987 | Raykovitz et al. . | |
| 4,839,439 | 6/1989 | Mauz . | |
| 4,859,516 | 8/1989 | Yamanaka et al. . | |
| 4,913,757 | 4/1990 | Yamanaka et al. . | |
| 4,952,265 | 8/1990 | Yamanaka et al. . | |
| 5,030,496 | 7/1991 | McGurran . | |
| 5,082,720 | 1/1992 | Hayes . | |
| 5,250,349 | 10/1993 | Nakagawa et al. . | |
| 5,336,552 | 8/1994 | Strack et al. . | |
| 5,340,869 | 8/1994 | Isobe et al. . | |
| 5,475,053 | 12/1995 | Niessner et al. . | |

OTHER PUBLICATIONS

Product Data for Vista Flex 671–N, Advanced Elastomer Systems, 1991.

Physical Property Data Commercial EMAC Grades Technical Data Sheet, Chevron Chemical Co., dated Nov. 21, 1991.

ELVAX Resins Grade Selection Guide, Du Pont Co., dated May 1990.

Polyolefins for Adhesives, Sealants and Coatings, Quantum Chemical Co., dated 1993.

BYNEL® adhesive resing Series 300, Including 3101, 3120, and E326 Acid/Acrylate–Modified Ethylene Vinyl Acetate Product Information, Du Pont Co.

FINA Polypropylene Technical Bulletin, Fina Oil & Chemical Co. dated Feb. 1995.

Kraton® G. Polymers, KG Features and Benefits, Shell Chemical Co., WTC95/73/11.

Kraton® G. Polymers, KG Polymers, Shell Chemical Co., WTC95/73/22.

Kraton® G. Polymers, Relative MW of KG Polymers, Shell Chem. Co., WTC95/73/23.

Kraton® G. Polymers, KG PSA Properties, Shell Chemical Co., WTC95/73/26.

Encyclopedia of Chemical Technology, 3rd Ed. Supp. vol., pp. 372–392, dated 1984.

Physical Properties of Textile Fibers, pp. 268–273, dated 1962.

Encyclopedia of Polymer Science and Engineering, vol. 6, pp. 830–831, dated 1986.

Concise Encyclopedia of Chemical Technology, pp. 380–385, dated 1985.

Bicomponent Fibers: Past, Present and Future, INDA, JNR V 4, No. 4, pp. 22–26, 1992.

Encyclopedia of Chemical Technology, 4th Ed. vol. 10, pp. 541, 542, 552, dated 1993.

Plastics Week, Modern Plastics, McGraw–Hill, Aug. 9, 1993.

European Chemical News, p. 23, dated Jul. 4, 1993.

Extrusion Dies, Design and Engineering Computations, by Walter Michaeli, Hanser Publishers, pp. 173–180, dated 1984.

3M Matting Products For Food Service, 3M, dated 1993, 70–0704–2686–4.

3M Floor Matting, 3m, dated 1993, 70–0704–2694–8.

Instruction Booklet No. 64–10, Tinius Olsen Testing Machine Co.

UNDRAWN TOUGH DURABLY MELT-BONDABLE MACRODENIER THERMOPLASTIC MULTICOMPONENT FILAMENTS

This invention relates to melt-extruded, melt-bondable, thermoplastic filaments or fibers, particularly multicomponent fibers, such as bicomponent fibers of the sheath-core type, precursor thermoplastic polymers therefor, and articles of such filaments or fibers, such as open, nonwoven webs useful in the form of entry-way floor matting or abrasive pads. In another aspect, this invention relates to methods of making the filaments or fibers and articles thereof. In a still further aspect, this invention relates to thermoplastic alternatives for poly(vinyl chloride).

Fibers based on synthetic organic polymers have revolutionized the textile industry. One manufacturing method of fiber formation is melt spinning, in which synthetic polymer is heated above its melting point, the molten polymer is forced through a spinneret (a die with many small orifices), and the jet of molten polymer emerging from each orifice is guided to a cooling zone where the polymer solidifies. In most instances the filaments formed by melt spinning are not suitable textile fibers until they have been subjected to one or more successive drawing operations. Drawing is the hot or cold stretching and attenuation of fiber filaments to achieve an irreversible extension and to develop a fine fiber structure. Typical textile fibers have linear densities in the range of 3 to 15 denier. Fibers in the 3 to 6 denier range are generally used in nonwoven materials as well as in woven and knitted fabrics for use in apparel. Coarser fibers are generally used in carpets, upholstery, and certain industrial textiles. A recent development in fiber technology is the category of microfibers with linear densities <0.11 tex (1 denier). Bicomponent fibers, where two different polymers are extruded simultaneously in either side-by-side or skin/core configurations, are also an important category of fibers. *Kirk-Othmer Encyclopedia of Chemical Technology*, Fourth Ed., John Wiley & Sons, N.Y., Vol. 10, 1993, "Fibers," pp. 541, 542, 552.

A type of bicomponent fiber is the bicomponent binder fiber, the historical paper by D. Morgan which appears in INDA *A Journal of Nonwoven Research*, Vol. 4(4), Fall 1992, pp. 22–26. This review article says it is worth noting that the majority of bicomponent fibers so far made have been side-by-side acrylics used in knitwear garments to provide bulk. Table 1 of this review article lists suppliers of various bicomponent fibers, which are of relatively low denier, ranging from about 1 to up to 20.

U.S. Pat. No. 4,839,439 (McAvoy et al.) and U.S. Pat. No. 5,030,496 (McGurran) describe nonwoven articles prepared by blending melt bondable, bicomponent sheath/core, polyester, staple fibers having a denier of six and larger, for example 15, with synthetic, organic, staple fibers, forming a nonwoven web from the blend, heating the web to cause the melt bondable staple fibers to initially bond, or prebond, the web, coating the web with a binder resin, and drying and heating the coated web.

U.S. Pat. No. 5,082,720 (Hayes) discusses prior art relating to nonwoven webs of bicomponent melt-bondable fibers. The invention of the Hayes patent is directed to drawn or oriented, melt-bondable, bicomponent filaments or fibers of 1 to 200 denier formed by the co-spinning of at least two distinctive polymer components, e.g., in a sheath-core or side-by-side configuration, immediately cooling the filaments after they are formed, and then drawing the filaments. The first component is preferably at least partially crystalline polymer and can be polyester, e.g., polyethylene terephthalate; polyphenylenesulfide; polyamide, e.g., nylon; polyimide; polyetherimide; and polyolefin, e.g., polypropylene. The second component comprises a blend of certain amounts of at least one polymer that is at least partially crystalline and at least one amorphous polymer, where the blend has a melting point of at least 130° C. and at least 30° C. below the melting point of the first component. Materials suitable for use as the second component include polyesters, polyolefins, and polyamides. The first component can be the core and the second component can be the sheath of the bicomponent fiber.

Filaments of poly(vinylchloride) ("PVC," or simply "vinyl"), a synthetic thermoplastic polymer, are used to make open or porous, nonwoven, three-dimensional, fibrous mats or matting. The mats are used for covering any of a variety of floors or walking surfaces, such as those of office building, factory, and residential entry-ways or foyers and hallways, areas around swimming pools, and machine operator stations, to remove and trap dirt and water from the bottom (soles and heels) of shoes, protect floors and carpets, reduce floor maintenance, and provide safety and comfort. Generally the mats are open or porous webs of interengaged or intertwined, usually looped, sinuous, or coiled, coarse or large-diameter fibers (or filaments); such fibers are typically melt-extruded from plasticized PVC into single-component fibers which are aggregated and bonded (usually with an applied binder coating or adhesive). An example of commercially-available matting product is Nomad™ matting constructed of interengaged loops of vinyl filaments that are bonded together and may be supported on and adhered to a backing—see product bulletins 70-0704-2684-4 and 70-0704-2694-8 of the 3M Company, St. Paul, Minn., U.S.A.

Relatively early patents describing matting made from various thermoplastics including PVC are U.S. Pat. No. 3,837,988 (Hennen et al.), U.S. Pat. No. 3,686,049 (Manner et al.), U.S. Pat. No. 4,351,683 (Kusilek), and U.S. Pat. No. 4,634,485 (Welygan et al.). Common aspects of the method described in these patents, briefly stated, comprises extruding continuous filaments of thermoplastic polymer downward toward and into a water quench bath where a web of interengaged, integrated, or intermingled and spot-bonded filaments is formed. The web can be subsequently treated with bonding agent or resin to improve bonding, strength, or integration. Typically, in the absence of a bonding agent or resin applied and cured subsequent to the web-forming step, the filaments of the web exhibit a tensile strength much greater than that of the spot-bond itself. That is, as a result of tensile force applied to the web after spot welding but before application of a subsequent bonding treatment, the fibers of the web will separate at the sites of interfilament bonding more frequently than the fibers will break.

Recently poly(vinyl chloride) has been said to be environmentally undesirable because its combustion products include toxic or hazardous hydrogen chloride fumes. It has been reported that the existing use of PVC in Sweden should be phased out by the year 2000—see *European Chemical News*, 4 Jul. 1994, p. 23. One Swedish commercial enterprise stated it plans to stop making PVC-based elastic flooring and launch a new, PVC-free flooring—see *Plastic Week*, Aug. 9, 1993. Thus attention is being directed to alternatives for PVC.

Bicomponent fibers and multicomponent fibers are described in *Kirk-Othmer Encyclopedia of Chemical Technology*, Third Ed., Supplement Vol., 1984, pp. 372–392, and *Encyclopedia of Polymer Science and Technology*. John Wiley & Sons, N.Y., Vol. 6, 1986, pp. 830, 831. Patents describing certain multicomponent or bicomponent fibers include U.S. Pat. No. 3,589,956 (Kranz et al.), U.S. Pat. No. 3,707,341 (Fontijn et al.), U.S. Pat. No. 4,189,338 (Ejima et al.), U.S. Pat No. 4,211,819 (Kunimune), U.S. Pat. No. 4,234,655 (Kunimune et al.), U.S. Pat. No. 4,269,888 (Ejima et al.), U.S. Pat. No. 4,406,850 (Hills), U.S. Pat. No. 4,469,540 (Jurukawa et al.), U.S. Pat. No. 4,500,384 (Tomioka et al.), U.S. Pat. No. 4,552,603 (Harris et al.), U.S. Pat. No. 5,082,720 (Hayes), U.S. Pat. No. 5,336,552 (Strack et al.). The process of manufacture of multicomponent fibers and a general discussion of the method of extrusion of these fibers are also described in *Kirk-Othmer*. Third Ed., loc. cit. Some patents describing spinneret assemblies for extruding bicomponent fibers of the sheath-core type are U.S. Pat. No. 4,052,146 (Sternberg), U.S. Pat. No. 4,251,200 (Parkin), U.S. Pat. No. 4,406,850 (Hills), and PCT International Appln. published as WO 89/02938 (Hills Res. & Devel. Inc.).

Some other patent filings, viz., U.S. Pat. No. 3,687,759 (Werner et al.) and U.S. Pat. No. 3,691,004 (Werner et al.), though they do not describe PVC matting, describe mattings of filaments of substantially amorphous polymer, such as polycaprolactam, which are formed by melt spinning into a liquid quench bath in such a manner that the filaments lie in the form of overlapping loops randomly bonded at their points of contact as they solidify in the bath. These patents state that preferably the filaments are spun, looped, and bonded without any substantial tension being placed on the filaments, or that it is preferable to avoid any substantial tension capable of stretching the filaments as they are withdrawn through the cooling bath so that the amorphous character of the initial polymer is largely retained. Matting articles which are formed without spinning into a liquid quench bath and consisting essentially of melt-spun filaments which are self bonded or fused at random points of intersection without using any bonding agent have been described in U.S. Pat. No. 4,252,590 (Rasen et al.).

A series of patents issued to Yamanaka et al., viz., U.S. Pat. Nos. 4,859,516, 4,913,757, and 4,95,265, describe various mats consisting of filament loop aggregations formed by extruding thermoplastic synthetic resin vertically toward the surface of a cooling bath of water at a speed regulated by guide rollers disposed in the water (to which a surface active agent can be added), the density of the aggregations of the resulting bonded or fused aggregations being regulated in certain manners.

The present invention provides undrawn, tough, durably melt-bondable, thermoplastic, macrodenier, multicomponent filaments that can be used in the formation of nonwoven webs for matting and abrasive products, for example.

In one aspect, the invention provides a multicomponent filament comprising:

(a) first component comprising synthetic plastic polymer; and (b) second component having a melting point lower than that of the first component, the second component comprising a first synthetic thermoplastic polymer and a second synthetic thermoplastic polymer, the first synthetic thermoplastic polymer comprising a block copolymer of styrene, ethylene and butylene wherein the styrene content is between about 1 to 20% by weight;

the filament being tough and durably melt-bondable in its undrawn state, the first and second components being, along the length of the filament, elongated, contiguous, and coextensive, the second component defining all or at least part of the material-air boundary of the filament.

The first and second components preferably are integral and inseparable (e.g., in boiling water), and the second component defines about 5 to 90%, preferably 20–85% of the material-air boundary or peripheral or external surface of the filament. The plastic of each of the first and second components can be a single plastic substance or a blend of a plurality of plastic substances and can consist or consist essentially of such plastic substances. The components can further comprise or have incorporated adjuvants or additives to enhance a property of or impart a property to the filament, such as stabilizers, processing aids, fillers, coloring pigments, crosslinking agents, foaming agents, and fire retardants. The filament can comprise a plurality, e.g., 2 to 5, of first components and/or of second components, a preferred multicomponent filament being a bicomponent filament, such as a sheath-core or side-by-side filament.

A particularly preferred first component is a blend of isotactic polypropylene and ethylene-propylene-butene copolymer. Preferably, the first synthetic thermoplastic polymer of the second component comprises a block copolymer of styrene, ethylene and butylene wherein the styrene content is between about 1 to 20% by weight and most preferably, the first synthetic thermoplastic polymer is a block copolymer comprised of ethylene-butylene-styrene units wherein the styrene content is about 13% by weight and the ethylene-butene content is about 87% by weight. An especially preferred block copolymer is that commercially available under the trade designation "KRATON" G1657 from Shell Chemical Company of Houston, Tex. which is a blend of 70 wt % triblock polymer comprised of styrene-ethylene- butylene -styrene (SEBS) and 30 wt % diblock polymer of styrene and ethylene- butylene (SEB). The weight average molecular weight of the diblock is approximately 40,000 and the weight average molecular weight for the triblock is approximately 80,000. The second synthetic thermoplastic polymer of the second component preferably comprises material selected from the group consisting of ethylene-propylene copolymer, ethylene vinyl acetate copolymer, ethylene methyl acrylate copolymer and ethyl methacrylate copolymer having a counterion comprising zinc.

In another aspect of this invention, a plurality of the above-described solidified filaments are self-bonded to one another by heating an aggregation thereof, e.g., in the form of an open, nonwoven web of the filaments in a coiled form, to or above the melting point of the second component in order to effect durable melt-bonding at filament surfaces in contact with melted second component, and thereby provide a sufficiently bonded aggregation of the filaments, e.g., an open, nonwoven web of durably melt-bonded, undrawn, tough, macrodenier, multicomponent filaments. Such bonding can be accomplished without requiring or using a coating or otherwise applying to the filaments a binder resin, solvent, or extra adhesive or mixing the filaments with so-called binder fibers, though such materials may be used to supplement the self-bonding of the filaments.

The foregoing webs can be used in any of a variety of articles including abrasive articles, matting (e.g., floor matting) and the like. Hence, another aspect of the invention provides abrasive articles, each article comprising an open, nonwoven web of the forgoing filaments, the filaments being durably melt bonded to one another at mutual contact points and further comprising abrasive particulate bonded to the surfaces of the filaments.

In another aspect, the invention provides matting comprising an open, nonwoven web of thermoplastic, sheath-core bicomponent filaments having a linear density greater than 200 denier per filament (dpf) and preferably between 500 and 20,000 dpf, the filaments being undrawn, tough and durably melt-bonded to one another at mutual contact points, the filaments each comprised of (a) a central core comprising a synthetic plastic polymer; and (b) a sheath comprising a block copolymer of styrene, ethylene and butylene wherein the styrene content is between about 1 to 20% and material selected from the group consisting of ethylene-propylene copolymer, ethylene vinyl acetate copolymer, ethylene methyl acrylate copolymer and ethyl methacrylate copolymer having a counterion comprising zinc.

Another aspect of this invention provides a method of making the above-described multicomponent filaments. Such method comprises continuous steps of simultaneously (or conjointly) melt-extruding, preferably at the same speed, molten streams of thermoplastic polymers (some of which are novel blends of polymers) as precursors of the first and second components via one or a plurality, e.g., 1 to 2500, preferably 500 to 1800, extruder die openings or orifices, in the form of a single or a plurality of discrete and separate hot, tacky, molten, multicomponent filaments, cooling them, for example, in a water quench bath, and recovering the resulting non-tacky, solidified filaments, for example, as a tow or web of such filaments.

The filaments of this invention, following their melt-extrusion and cooling to a solidified form, are not subsequently or additionally drawn, that is, stretched, pulled, elongated, or attenuated. In contrast, textile fibers, including bicomponent textile fibers, are commonly drawn as much as, for example, 2 to 6 or even 10 times their original length, usually to increase their strength or tenacity.

The filament of this invention, as that term is used herein, is an elongated or slender article which is narrow or small in width, cross section, or diameter in proportion to its length. Generally the filament can have a width, diameter, or cross-section dimension of about 0.15 mm or greater, typically in the range of 0.5 to 25 mm, preferably 0.6 to 15 mm, such dimension (and shape of the cross section) being preferably substantially or essentially uniform along the length of the filament, e.g., uniformly round. The surface of the filament is typically smooth and continuous. Because the filament is larger in cross section in comparison to bicomponent textile-size or textile-denier filaments or "fine" fibers (which are generally considered to be 1 to 20 denier per fiber or "dpf"), the filament of this invention is relatively coarse and can be characterized (especially as compared to textile fibers) as being or having a macrodenier (and can even be characterized as being a macrofilament). Generally the filament of this invention has a linear density greater than 200 dpf and as much as 10,000 dpf or more, e.g., possibly up to 500,000 dpf or more, but preferably the filaments of this invention have linear densities in the range of 500 to 20,000 dpf.

The multicomponent filaments of this invention can be in the shape or form of fibers, ribbons, tapes, strips, bands, and other narrow and long shapes. Aggregations of the filaments, such as open, nonwoven webs, can be made up of a plurality of filaments with the same or different plastic compositions, geometric shapes, sizes and/or deniers. A particular form of such filaments is side-by-side (or side-side) bicomponent filaments or, preferably, sheath-core (or sheath/core) bicomponent filaments, each comprising the first and second components with one or more (e.g., 1 to 9) interfaces between the components and with the material-air boundary of the filament defined at least in part by an external surface of the second component. In a typical sheath-core filament, the sheath, or second component, provides a matrix (with a continuous external surface, the filament's material-air boundary) for one or more first components in the form of cores. The filaments can be solid, hollow, or porous and straight or helical, spiral, looped, coiled, sinuous, undulating, or convoluted. They can be circular or round in cross section or non-circular or odd in cross section, e.g., lobal, elliptical, rectangular, and triangular. They can be continuous in length, that is, of indefinite length, or, by cutting them in that form, they can be made in a short, discontinuous, or staple form of definite length. The first and second components can be solid or noncellular, or one or both components can be cellular or foamed with open and/or closed cells. Both of the first and second components can have the same form or shape or one of them can have one form or shape and the other component can have a different form or shape.

In characterizing the multicomponent filament of this invention as durably melt-bondable, this means that a plurality or aggregation of such filaments, such as an open, nonwoven web, can be bonded together at their points of contact or intersection to form an interfilament-bonded structure by heating the filaments sufficiently to or above the melting point of their second component in order to melt the second component without melting their first component, and then cooling the filaments to solidify second component, thereby causing the filaments to become bonded, to one another by a bond of second component at each of their contiguous material-air boundaries, points of contact, or intersections. Such melt-bonding of the filaments is a self-bonding in that it is effected without using or requiring the application of an external bonding agent, or solvent, or adhesive coating applied to the filaments or mixing so-called binder fiber therewith. This self-bonding feature is thus an environmental or cost advantage of the filaments of this invention vis-à-vis those known filaments or fibers that use or require such agent, solvent, coating, or binder fiber for bonding. This self-bonding may additionally be characterized and differentiated from spot- or tack-bonding, spot welding, or removably-welding by the strength of the bond formed.

The melt-bond achieved by the filaments of this invention is a durable bond in that it is sufficiently strong or fracture resistant that interfilament melt-bond strength generally is at least as great as that of the strength of the filament itself, and generally the melt bond strength exceeds 1.4 MPa, and preferably is at least 4.8 MPa (ca 700 psi), based on the cross-section area of the filament before breaking stress is applied thereto. In a tack-bonded structure, such as that of an open, nonwoven web of coiled filaments, tack-bonded filaments can be relatively easily separated from the structure, e.g., by a pulling stress of less than 0.02 MPa (ca 3 psi), based on the cross-section area of the filaments before breaking stress is applied thereto, without distorting or breaking the filaments themselves. The fact that melt-bonded filaments of this invention themselves break, rather than their melt-bonds, attests to the durably melt-bondable character of the filaments (as well as to the durable melt-bonded character of a melt-bonded aggregation of the filaments, such as an open nonwoven web).

Furthermore, the multicomponent nature of the filaments provides an unexpected advantage by allowing the first component thereof to provide a structural role in supporting the shape of the web of such filaments in either a post-formation melt-bonding step. It has also been found that the preferred materials for the second component provide an unexpected synergy in their ability to thermally bond with certain materials and especially to other fibers or surfaces comprised of the same materials. For example, it has been observed that a second component comprised of ethylene vinyl acetate copolymer and a block copolymer of styrene, ethylene and butylene wherein the styrene content is between about 1 to 20% by weight (e.g., KRATON G 1657 material), will thermally bond to another similar material at a bond strength exceeding that expected from measurement of the bond strengths for the individual materials (e.g., ethylene vinyl acetate copolymer bonded to itself and block copolymer separately bonded to itself).

Because the filaments of this invention are self- or melt-bondable, webs formed from the melt-bonded filaments of this invention are durable without requiring the application of binding agent, or adhesive coating, or solvent and can be used for article fabrication once the webs are melt-bonded.

The multicomponent filaments of this invention may be fabricated into articles or structures or three-dimensional aggregations of filaments comprising a plurality of the filaments, which can be in either continuous or staple form. For example, the aggregations may be in the form of open, permeable or porous, lofty webs or batts of interengaged, intertwined, interlocked, or entangled filaments or twisted, woven, or braided filaments that can be generally straight or helical, spiral, looped, coiled, curly, sinuous or otherwise convoluted filaments which can extend from one end of the web to the other end. The contiguous material-air boundaries of the filaments can be melt-bonded at their points of intersection or contact to form a water permeable, lofty or low bulk density, unitary, monolithic, coherent or dimensionally-stable, three-dimensional filamentary structure or mass, such as an open, nonwoven web, minimal, or any, melted thermoplastic filling up the interfilament gaps or interstitial spaces of the structure.

Webs can be cut to desired sizes and shapes, for example, in lengths and widths useful, for example, as floor covering or door mats for building entrances and other walkway surfaces. If desired, the web can be first melt-bonded on one side to suitable backing, such as a thermoplastic sheeting, prior to cutting into mats. Such masses, aggregations, or structures, when used as matting, provide resilient cushioning in the form of lofty, open, low bulk density, pliable mats or pads to cover floors or walking surfaces to protect the same from damage by dirt, liquid, or traffic wear, to provide safety and comfort to those people who walk or stand thereon, and to improve the aesthetic appearance of such substrates. Such mats can be stood or walked upon by people over a very long time with comfort and safety and without losing their durability. The mats are preferably of such low bulk density or high void volume that, in holding them up to a light source, light can be seen therethrough and dirt or water tracked thereon readily falls or penetrates therethrough. Generally, such mats can be used where PVC matting has been or can be used and as an alternative thereto, and, specifically, for those applications described in the above-cited 3M Company bulletins, which descriptions are incorporated herein by reference.

The filamentary mass or web of this invention can also be used as a spacer or cushioning web, a filter web, as the substrate of scouring pads, erosion-control or civil engineering matting for retaining soil on embankments, dikes, and slopes and the like to protect them from erosion, as a substrate or carrier for abrasive particles and the like, and as a reinforcement for plastic matrices.

The multicomponent filaments of this invention can be fabricated with indeterminate length, that is, in truly continuous form and, if desired, made as long in length as the supply of melt precursor or feed thereof lasts and having a length dependent only on the limitations of the fabricating equipment. Webs formed from these continuous filaments can be readily cut to desired dimensions, for example, after they are intertwined or intermeshed as looped or coiled, bonded filaments in the form of an open, nonwoven web or matting. Alternatively, these continuous filaments can be cut into staple length fibers, for example, 2.5–10 cm in length, and such short lengths can used, for example, in a bonded aggregation as a substrate for abrasive cleaning and polishing pads in applications like those whose fabrication is described in the U.S. Pat. No. 5,030,496 and U.S. Pat. No. 2,958,593 (Hoover et al.), which descriptions (except for the requirement of an adhesive coating) are incorporated herein by reference.

Preferably the filaments of this invention are melt-extruded as a bundle or group of free falling, closely spaced, generally parallel, discrete, continuous, multicomponent filaments of hot, tacky, deformable, viscous polymer melts, for example, as sheath-core bicomponent fibers, the hot filaments then being quickly cooled, or quenched, to a non-tacky or non-adhesive solid state. The hot filaments can be so-cooled or quenched to form a tow of non-tacky, essentially solid, discrete continuous filaments by contact with a cooling means or medium, such as a liquid quench bath, e.g., a body of water. The tow can then be advanced or conveyed through the bath and withdrawn therefrom. The tow may then be further cooled, if desired. The tow can be used to fabricate nonwoven pads, such as those whose fabrication is described in U.S. Pat. No. 5,025,591 (Heyer et al.), used for scouring pots and pans, etc., or the tow can be cut into staple lengths which can be used to make abrasive pads, such as those whose fabrication is described in U.S. Pat. No. 2,958,593 (Hoover et al.), which descriptions (except for the requirement of an adhesive coating) are incorporated herein by reference. If the speed at which the tow is withdrawn from the quench bath, i.e., the take-away speed, is equal to or greater than the speed of the hot filaments entering the quench bath, the tow will comprise essentially straight, non-coiled, non-convoluted, discrete filaments.

A tow comprised of helically shaped, coiled, or convoluted, discrete, continuous, multicomponent filaments, one such filament being shown in FIG. 4, can be formed in the above-described fashion if the tow is conveyed through the quench bath at a take-away speed which is less than the speed of the filaments entering the quench bath so as to permit the falling, molten, still deformable filaments to coil into an essentially helical shape adjacent the surface of the quench bath. The free-falling molten filaments preferably are sufficiently spaced-apart to prevent individual filaments from interfering with the coiling action of adjacent filaments. The use of a surfactant (for example, as described in the U.S. Pat. No. 3,837,988) in the quench bath may be desirable to aid coil formation.

A web of coiled, multicomponent filaments can be formed by permitting the bundle of melt-extruded, free-falling filaments to (i) deform, coil, wind, or oscillate in a sinuous manner, (ii) interengage, intertwine, or aggregate in a desired ordered or random pattern to a desired web weight, (iii) tack- or spot-bond upon contact with each other, and (iv) immediately thereafter cool to a non-tacky, solid state. The free-falling molten filaments in the bundle are sufficiently spaced-apart to allow intermingling of the coiling and overlapping filaments. The take-away speed of the web preferably is sufficiently slow relative to the speed of the filaments entering the quench bath so as to allow the falling, coiling filaments to aggregate adjacent the surface of the quench bath as described in the U.S. Pat. No. 4,227,350 or alternatively to aggregate on one or more contact surfaces adjacent the surface of the quench bath. The contact surface(s) may be in motion, as for example the surface of a rotating cylindrical drum as described in the U.S. Pat. No. 4,351,683, so as to collect the newly-forming web and help convey it into and/or through the quench bath. The substrate may alternatively be stationary, for example, a plate as described in the U.S. Pat. No. 3,691,004. The descriptions of the U.S. Pat. Nos. 4,227,350, 4,351,683, and 3,691,004 are incorporated herein by reference.

The lightly-unified web thus formed comprises overlapping or entangled loops or coils of filaments and has sufficient structural integrity to allow the web to be conveyed, transported, or otherwise handled. The web can be dried and stored if necessary or desired prior to the melt-bonding step. This melt-bonding step involves heating the lightly-unified web to cause melting of the lower-melting plastic of the second component without deforming the first component, and then cooling the web to re-solidify the second component in order to effect melt-bonding at points of intersection of the filaments to form an open, durably melt-bonded web.

In the above-described methods of fabricating multicomponent filaments of this invention, unlike methods commonly used to manufacture single component or bicomponent fibers, such as textile fibers, the multicomponent filaments of this invention, as stated above, are undrawn. That is, the filaments of this invention are not mechanically, aerodynamically, or otherwise drawn, stretched, or pulled after they are quenched. The filaments, after having been quenched, are not attenuated, as for example, with a mechanical draw unit, air aspirator, air gun, or the like, so as to reduce their diameter, width, or cross-sectional area. After the hot filaments are cooled and solidified from their hot, tacky, molten state to their non-tacky, solidified state, their diameters, widths, or cross-sectional areas and shape remain substantially or essentially the same in their finished state, that is, after tow collection or web formation and subsequent melt-bonding steps, as when first cooled to the solid state. In other words, although the cooled and solidified filaments can be thereafter aggregated, melt-bonded, conveyed, wound, or otherwise handled or processed, such handling is done in a relatively relaxed manner without any substantial tension being placed on the solidified filaments. Thus, once solidified, the filaments of this invention are processed in an essentially tension-less manner, without substantial or significant attenuation, so that their denier or magnitude after processing to their finished form can be essentially the same as that upon first cooling the viscous filaments; consequently, the filaments are said to be undrawn.

Notwithstanding the multicomponent filaments of this invention are undrawn, they are tough, that is, strong and flexible but not brittle or fragile, and the melt-bonded aggregations of such filaments are durable, that is, resistant to fatigue due to constant flexing, even though their bonding is achieved without use of an added or applied bonding or adhesive agent, such as coating with an adhesive coating solution or mixing the filaments with added known binder fibers. In contrast to drawn fibers, the cooled, solidified filaments of this invention can be readily stretched or drawn by grasping such a filament by two hands—one on each end of a segment (e.g., 10 cm long)—and pulling the segment between them, for example, to 2 or more times its initial length, thereby attenuating the filament diameter or cross-sectional area.

Because of the non-PVC thermoplastics which can be used to fabricate the multicomponent filaments of this invention, environmental regulations which restrict the use of PVC will not necessarily be applicable to the fabrication, use, or disposal of the filaments of this invention. Another environmental advantage is that no adhesive or volatile solvents are required to durably bond the filaments of this invention in the form of a unitary or monolithic structure, such filaments being self-bondable, that is, melt-bonding at their contiguous material-air boundaries or surfaces that are heated to melt the lower melting plastic of the second component of such filaments and thermally bond the same at the boundaries or surfaces.

BRIEF DESCRIPTION OF THE DRAWINGS

In the accompanying drawing, which depicts or illustrates some embodiments and or features of this invention, and where like reference numbers designate like features or elements.

Figure 1A:
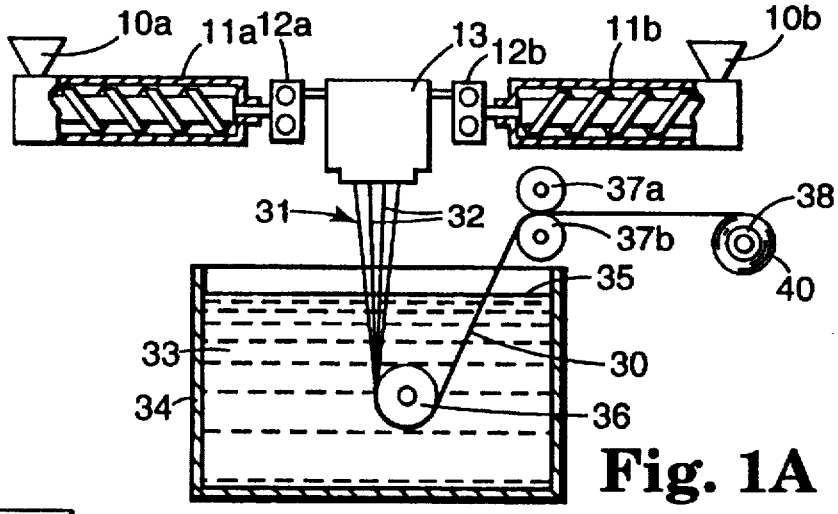
FIG. 1A is a schematic view in elevation and partial cross-section showing one embodiment of apparatus that can be used to make a tow of straight or uncoiled, multicomponent filaments of this invention.

Referring now to the drawing, and initially to FIG. 1A, a first thermoplastic polymer composition, to be used to form a first component of bicomponent filaments of this invention, is fed in pellet, crumb, or other form into the hopper 10*a* of a melt extruder 11*a*, from which a stream of polymer melt (e.g., at 100° to 400° C.) is fed, optionally under pressure of a metering pump 12*a*, into a bicomponent extrusion die assembly 13. Similarly, a second thermoplastic polymer composition to be used to form a second component of the bicomponent filaments is fed into the hopper 10*b* of melt extruder 11*b*, from which a stream of polymer melt is fed, optionally under pressure of metering pump 12*b*, into the extrusion die assembly 13. Examples of equipment for extruding bicomponent fibers are described in *Kirk-Othmer*, Third Ed., Supp. Vol. supra, p. 380–385. Examples of extrusion die assemblies in the form of spinnerets are described in U.S. Pat. No. 4,052,146 (Steinberg), U.S. Pat. No. 4,406,850 (Hills) and U.S. Pat. No. 4,251,200 (Parkin), PCT Appln. WO 89/02938 (Hills Research and Development Inc.), and Brit. Pat. 1,095,166 (Hudgell). Examples of extrusion dies are described by Michaeli, W. in *Extrusion Dies, Designs and Computations*, Hanser Pub., 1984, pp. 173–180. These descriptions of technology are incorporated herein by reference, and the equipment therein can be modified in dimensions and configuration by those skilled in the art for use in extruding the macrodenier, multicomponent filaments of this invention in light of the description of it herein.

Figure 2A:
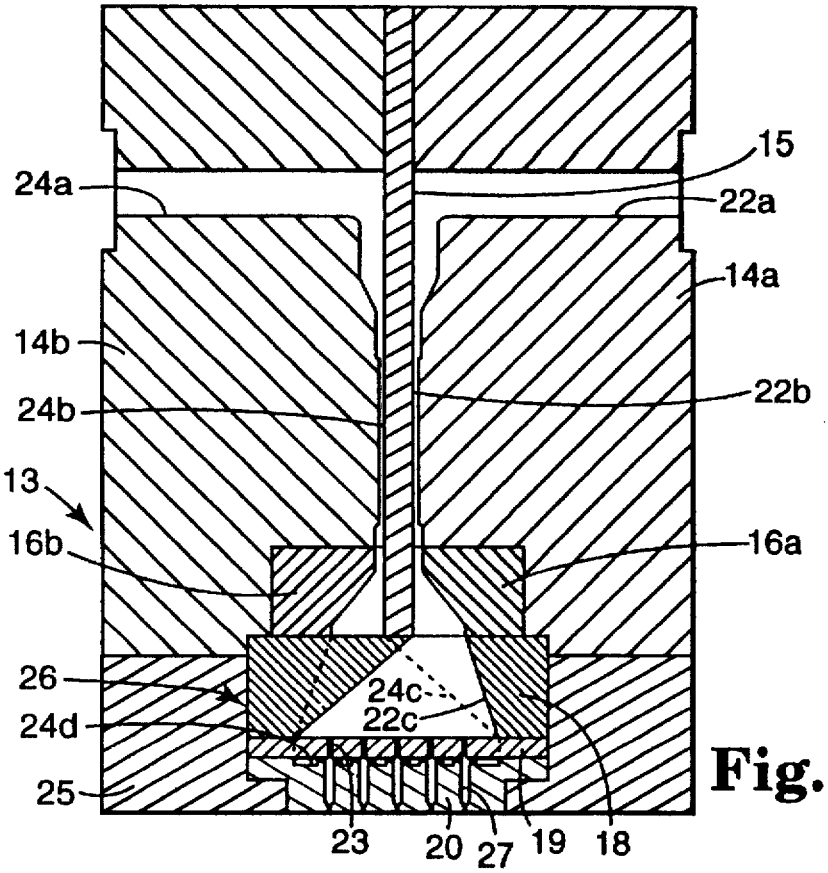
FIG. 2A is a schematic view in elevation and cross section of a portion of an extruder die assembly useful in the apparatus of FIGS. 1A–1D for melt-extruding sheath-core filaments of this invention.
Figure 2B:
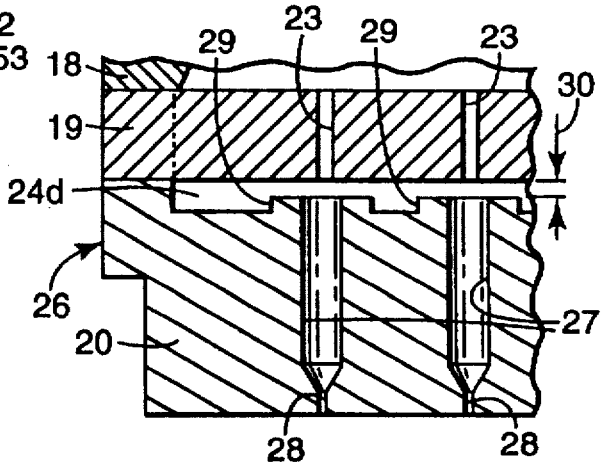
FIG. 2B is a enlarged view in cross section of a portion of FIG. 2A.

FIGS. 2A and 2B illustrate the bicomponent, filament, extrusion die assembly 13 of FIG. 1A, such assembly being made of a number of machined metal parts having various chambers, recesses, and passages for the flow of molten thermoplastic and rigidly held together by various means (not shown in the drawing), such as bolts. Assembly 13 comprises a dual-manifold of the slit type made up of mating blocks 14*a* and 14*b* each having a manifold passage disposed therein and separated by a vertical plate 15. Manifold blocks 14*a* and 14*b* are provided with opposing recesses at the lower ends in which is inserted a mating pair of prelip blocks 16*a*, 16*b* with flared, opposed inner surfaces separated by the lower portion of plate 15. Blocks 14*a*, 14*b* surmount a lower die holder 25 having a recess to accommodate an inserted extrusion die pack 26 of the castellation type and comprising stacked plates, viz., top plate 18, center or distribution plate 19, and lower or orifice plate 20 from which issue hot, viscous, tacky, sheath-core filaments formed in the pack. Viscous core polymer composition, first component of the filaments, is caused to flow from a feed passage 22*a* within manifold block 14*a* to distribution manifold passage 22*b* and thence into chamber 22*c* in top plate 18 that functions as a local manifold from which the core polymer melt flows into an array of vertical core flow passages 23 in plate 19. Viscous sheath polymer composition, second component of the filaments, is simultaneously caused to flow from a feed passage 24*a* within dual manifold block 14*b* to a second polymer distribution manifold passage 24*b* and thence into a second and separate chamber 24*c* in top plate 18 that functions as a local manifold from which the sheath polymer melt flows downwardly through a rectangular channel (shown by the broken line) in center plate 19 to a horizontal recess or cavity 24*d* disposed between center plate 19 and orifice plate 20. The latter has an array of circular vertical channels 27 axially aligned with core flow passages 23. Channels 27 communicate at their upper ends with recess 24*d* and terminate at their lower ends with extruder nozzles having orifices 28. As shown clearly in FIG. 2B, the upper face of the orifice plate 20 defining the bottom of recess 24*d* is machined with an array of raised, circular protuberances, buttons, or castellations 29, each surrounding the upper or inlet end of a channel 27 and defining a fine gap 30 between their upper surface and the lower face of distribution plate 19 (or top of recess 24*d*) to ensure uniform sheath thickness. The sheath melt flows in fine gap 30 and enters channels 27 around the respective streams of core melt flowing from passages 23 into the cores of the channels so that bicomponent sheath-core filaments issue from orifices 28, the cross section of such a filament being shown in FIG. 7.

Referring again to FIG. 1A, the extruder die assembly 13 continuously extrudes downwardly, in relatively quiescent air, a plurality or bundle 31 of hot, viscous, tacky, closely-spaced, discrete, continuous, macrodenier, multicomponent filaments 32 which fall freely into a body or bath 33 of quench liquid, such as water, in an open-top tank 34. The surface 35 of the bath 33 is disposed a suitable distance below the lower face of the extrusion die assembly 13 in order to maintain the discrete nature of falling filaments in the zone of cooling air above the bath. The bundle 31 upon entering the bath 33 is quickly cooled or quenched from the extrusion temperature, e.g., 100° to 400° C., down to about 50° C., and solidified to a non-tacky state. The discrete, quenched filaments 32 are continuously gathered or collected and are guided around turnaround roll 36 as a tow 30 which is conveyed by a pair of pinch rolls 37*a* and 37*b* out of the bath. The tow 30 may then be wound on winder 38 to form a tow winding 40.

Figure 1B:
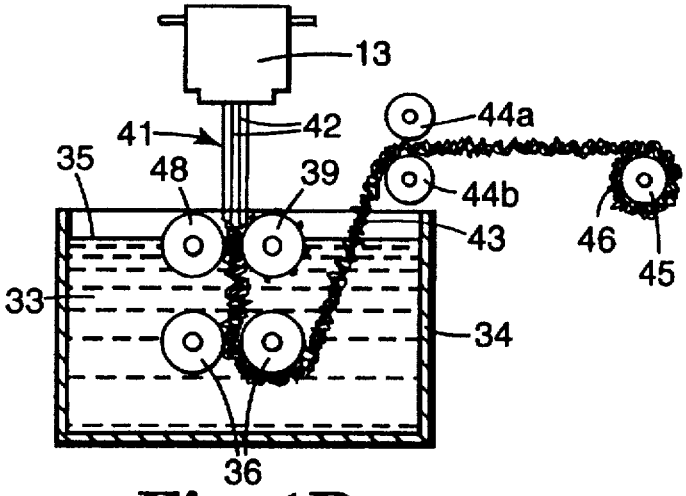
FIG. 1B is a schematic view in elevation and partial cross-section showing another embodiment of apparatus that can be used according to this invention to make coiled multicomponent filaments and an open, nonwoven web thereof.
Figure 3:
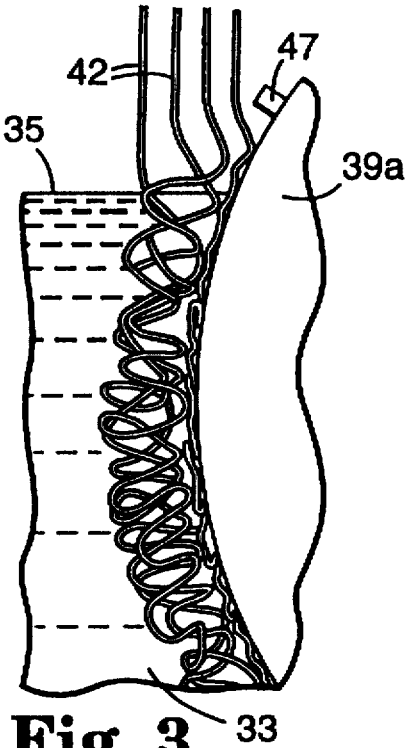
FIG. 3 is a enlarged view of a portion of FIG. 1B.
Figure 4:
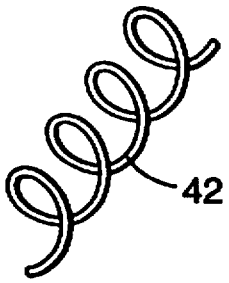
FIG. 4 is a schematic isometric view of a single multicomponent filament of this invention in its helical or coiled form.

In a similar fashion, referring now to FIG. 1B, the extruder die assembly 13 (which, as in FIG. 1A, is connected to extruders and optionally to metering pumps, not shown in FIG. 1B) extrudes downwardly a plurality or bundle 41 of hot, viscous, tacky, closely-spaced, discrete, continuous, macrodenier, multicomponent filaments fibers 42 which fall freely in the quiescent ambient air into tank 34. The bundle 41 can be aligned so that some of the hot, viscous filaments 42 are permitted to make glancing contact with the outer surface of a guide roll 39, optionally provided with spaced-apart guide pins or pegs 47 (see FIG. 3), or some other type of guide, such as a stationery plate, to guide the hot, viscous filaments as they move toward the surface 35 of a body or bath 33 of quench liquid, such as water, in tank 34, the surface of the liquid being disposed a suitable distance below the lower face of the extruder die assembly of 13 so as to achieve the desired diameter of the filaments as they enter the bath. The roll 39 can be set to cause glancing contact with the filaments 42, as described in the U.S. Pat. No. 4,351,683, which description is incorporated herein by reference. As the hot, viscous filaments 32 fall in the ambient air, they begin to cool from the extruding temperature (which can range, for example, from 100° C. to 400° C.). The guide roll 39 (as well as optional roll 48 and other rolls downstream) can be set to rotate at a predetermined speed or rate such that the rate of lineal movement of the filaments 42 as they enter the body 33 of quench liquid is slower than the rate of linear movement of the hot, viscous filaments upstream of the guide roll(s). Since the take-away speed is slower than the speed of the hot filaments entering the quench bath 33, and the filaments 42 are still in a sufficiently viscous, deformable, or molten state, the filaments accumulate or aggregate themselves by coiling, undulating, or oscillating and interengaging just above the surface 35 of the quench liquid 33 into which they enter and can further cool, e.g., to about 50° C., quickly enough so that their shape does not deform, and solidify or rigidify just below the surface 35. A degree of resistance is imparted to the flow or free fall of the hot, viscous filaments 42 above the surface 35 by the already quenched, aggregated filaments in the quench bath 33 below its surface, which causes the still deformable filaments entering the quench bath to coil, oscillate, or undulate just above the surface of the bath. This motion establishes irregular or random periodic contact between the still-hot filaments, resulting in spot- or tack-bonding of contiguous surfaces of the filaments at their points of contact or intersection. Consequently, the filaments 42 assume a coiled, looped, sinuous, or undulating configuration and become interengaged as illustrated in FIG. 3, one such filament being shown in FIG. 4. The filaments 42 upon entering the quench liquid 33 and passing adjacent immersed guide roll 39 form an integrated web 43 of lightly spot- or tack-bonded, solidified filaments.

The web 43 can be conveyed and withdrawn from the tank 34 by means of pinch rolls 44*a* and 44*b* and wound by roll 45 to form a winding 46 of the web. In this tack- or spot-bonded form, the filaments, though interengaged and lightly bonded, generally can be individually and easily pulled by hand from the web 43 and stretched to uncoil or straighten them in continuous form under such hand-pulling and without attenuation, showing that their tack-bonding is not durable. The web 43 can be unwound from winding 46 and placed in an air-circulating oven or the like to heat the web to an appropriate temperature for a sufficient time, e.g., 120° to 300° C., preferably 140° to 250° C., for 1 to 5 minutes, and then cooled to room temperature (e.g., 20° C.) to cause durable melt-bonding of the contiguous surfaces of the filaments in the web at their points of contact and form a finished, integral, unitary web with high void volume, e.g., 40 to 95 vol. %. The time and temperature for this melt-bonding will be dependent upon selecting the desired polymers for components (a) and (b) of the multicomponent filaments.

Figure 1C:
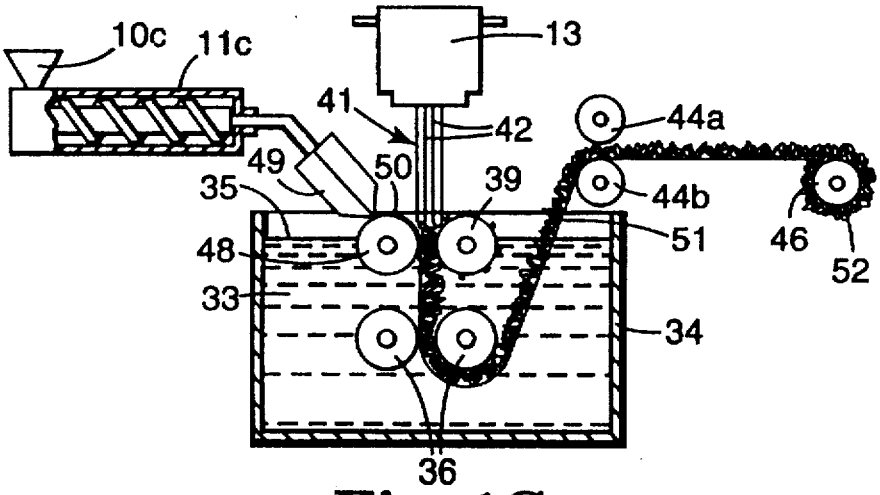
FIGS. 1C and 1D are schematic views in elevation and partial cross-section showing embodiments of apparatus that can be used to make backed, open, nonwoven webs of coiled multicomponent filaments in accordance with this invention.

Referring to FIG. 1C, a web of coiled filaments is fabricated as in FIG. 1B, but the web is laminated with a thermoplastic backing as both are formed. For such lamination a separate extruder 11*c*, provided with hopper 10*c*, is used to provide a thermoplastic melt which is supplied to a film die 49 which extrudes a backing film or sheet 50 which can comprise a thermoplastic of the types used to form filament second component. Such film 50 is directly cast on roll 48 prior to the zone on roll 39 that is also used to form a densified surface of filaments on the web. Some of the downwardly-extruded, hot filaments that comprise the densified portion of the web are laid down on the still hot, cast backing, thereby ensuring good bonding between the backing and the web. The resulting web-backing laminate 51 is conveyed to winder 46 to provide a winding 52 of backed web, which can be placed in a melt-bonding oven to ensure durable melt-bonding.

Figure 1D:
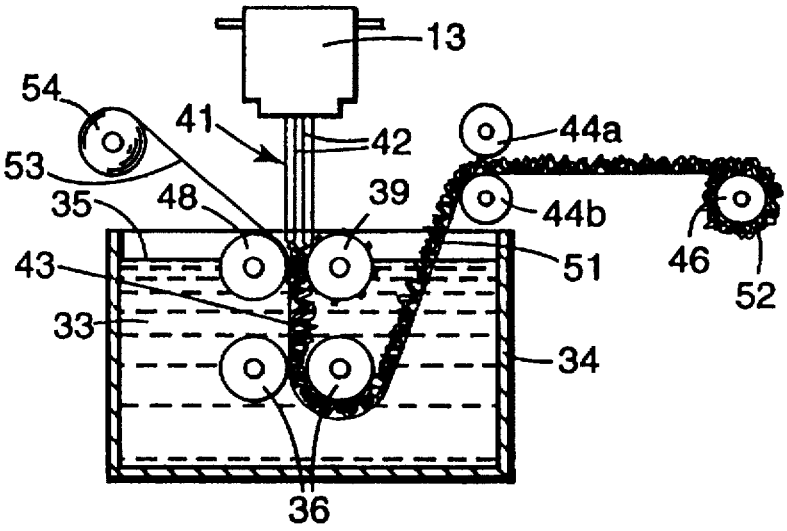

Referring to FIG. 1D, a web of coiled filaments is also fabricated as in FIG. 1B, but an unheated or cool preformed backing 53, which can be thermoplastic of the types used for filament second component, is supplied by roll 54 and placed in contact by roll 48 with the hot web of filaments and tack-bonded to the surface thereof, the resulting web-backing laminate 51 being conveyed by rolls 44*a*, 44*b* and wound by roll 46 to form a winding 52, which can also be melt-bonded in an oven.

Figure 5:
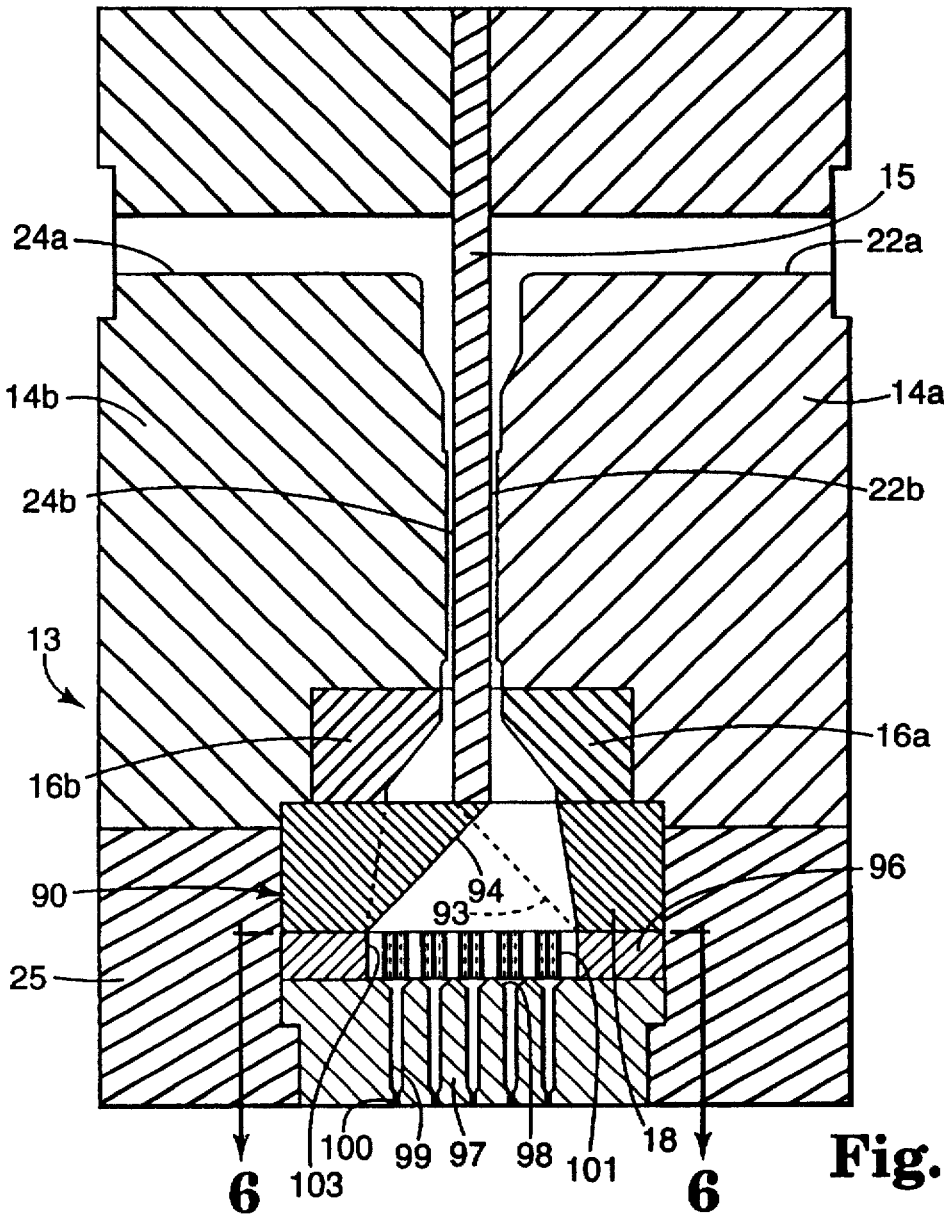
FIG. 5 is a schematic view in elevation and cross section of a portion of another extruder die assembly useful in the apparatus of FIGS. 1A–1D.
Figure 15:
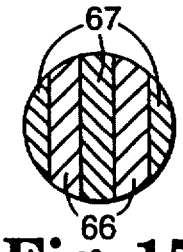
FIGS. 15 to 17 are schematic cross-sections of side-by-side multicomponent filaments of this invention.
Figure 6:
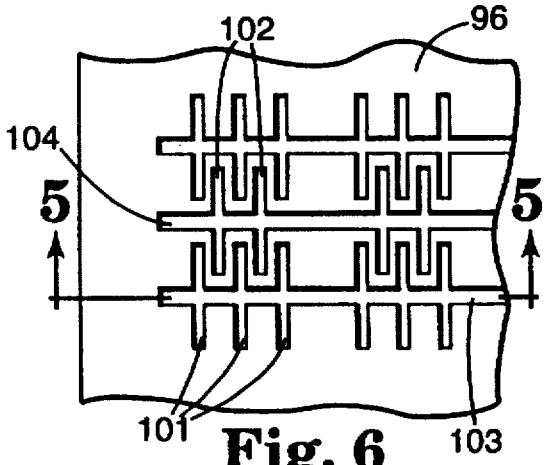
FIG. 6 is a partial cross-section and enlarged view of FIG. 5 taken along the line 6—6 thereof.

FIGS. 5 and 6 illustrate a multicomponent, five-layer filament extrusion die version of extrusion die assembly 13 of FIGS. 1A and 1B, the die pack 90 of this version comprising top plate 18, center distribution plate 96, and lower or orifice plate 97 from which issue hot, viscous, tacky, five-layer filaments formed in the pack. One such filament, with side-by-side alternate layers, is depicted in FIG. 15 and as having three layers 67 of second component separated by two layers 66 of first component. Viscous polymer composition, used to form layers 67 of the filament of FIG. 15, is caused to flow from feed passage 22*a* to feed manifold 22*b* to a chamber 94 in top plate 18 that functions as a local manifold from which the polymer melt flows into an array of vertical flow passages 101 each disposed outwards from a central channel 103 in center plate 96. Viscous polymer composition, used to form layers 66 of the filaments, is simultaneously caused to flow from feed passage 24*a* to feed manifold 24*b* to a chamber 93 in top plate 18 that functions as a local manifold from which the polymer melt flows into an array of vertical flow passages 102 disposed outwards from a central channel 104 in center plate 96. Channels 103 and 104 axially align with chambers 94 and 93, respectively. Lower plate 97 has an array of circular, vertical channels 99 that is axially aligned with the center of a set of interposed arrays of vertical flow passages 101 and vertical flow passages 102. Channels 99 communicate with the set of arrays of vertical flow passages 101 and 102 and terminate at their lower ends with extrusion nozzles having orifices 100. The upper face of orifice plate 97 is machined with rectangular countersunk depressions 98, each surrounding the upper or inlet end of a channel 99 and defining a cavity between its upper surface and the lower face of distribution plate 96. The component melt streams that will form layers 66 and 67 of the filament shown in cross section in FIG. 15 flow through the passages 102 and 101, respectively, of plate 96, entering the cavity in plate 97, merging to form a single melt stream of five alternating layers and entering channel 99 so that five-layer, multicomponent filaments issue from orifices 100.

In general, the bulk density (or void volume), width, thickness, and loftiness of the webs made from filaments of this invention can be varied by selecting the desired polymers and combinations thereof for forming the multicomponent filaments, the configuration or geometry and dimensions of the extrusion die pack (and the number, size, and spacing of the orifices thereof), and the speed of the various rolls used to convey the web in the quench tank and to wind up the finished web.

Figure 7:
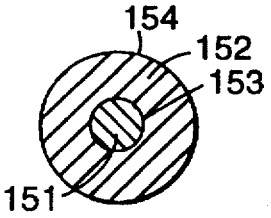
FIGS. 7 to 14 are schematic cross-sections of sheath-core multicomponent filaments of this invention.
Figure 8:
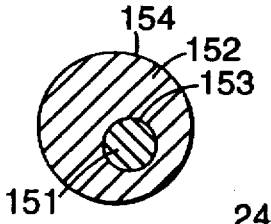
Figure 9:
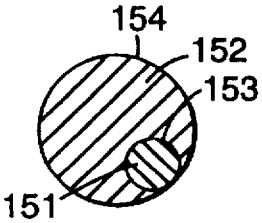
Figure 14:
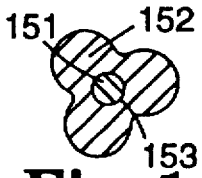

Referring again to the accompanying drawing, FIGS. 7, 8, 9, 11, and 14 illustrate the cross sections of round, circular or trilobal, sheath-core filaments of this invention, each with a single core 151 and a single sheath 152 with a single interface 153 between them. In FIG. 7, the core 151 and sheath 152 are concentric. In FIG. 8, the core 151 is eccentrically disposed within the sheath 152. In both FIGS. 7 and 8, the material-air boundary or peripheral surface 154 of the filaments is defined by the exposed surface of the sheath 152. In FIG. 9, the material-air boundary 154 of the filament is defined in part by the peripheral surface of the sheath 152 and in part by an exposed portion of the core 151 (if that exposed portion were larger, the filament might be more properly called a side-by-side filament). In FIG. 14, the core component 151 is essentially centrally disposed within a trilobal sheath 152.

Figure 10:
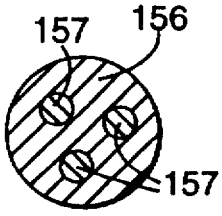
Figure 11:
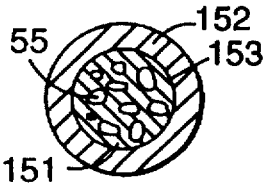
Figure 12:
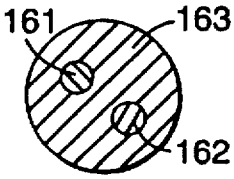
Figure 13:
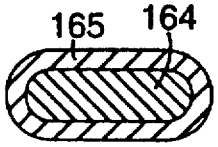

FIG. 11 shows a core 151 which is foamed or cellular, reference number 55 designating one of the many closed cell dispersed therein. FIG. 10 illustrates another embodiment of a sheath-core filament of this invention where the sheath 156 surrounds or provides a matrix for a plurality of spaced-apart parallel cores 157 of the higher-melting filament first component. In FIG. 12, two, spaced-apart, parallel cores 161, 162 of dissimilar plastic components (a) are disposed within the sheath 163. FIG. 13 shows a filament having central core 164 and sheath 165 with generally rectangular or elliptical cross-sections.

Figure 16:
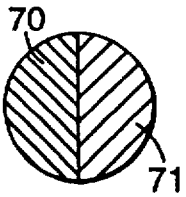
Figure 17:
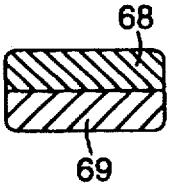

FIGS. 15, 16, and 17 illustrate various embodiments of side-by-side multicomponent filaments of this invention. In FIG. 15, layers 66 of the higher melting plastic first component and layers 67 of the lower melting plastic second component are alternately disposed in the filament. FIG. 16 illustrates a side-by-side bicomponent filament composed of the higher melting component 70 and lower melting component 71. In FIG. 17, the bicomponent filament is generally rectangular in cross section and composed of a stripe or ribbon 68 of the higher melting plastic first component and a contiguous strip 69 of the lower melting plastic second component.

Figure 18:
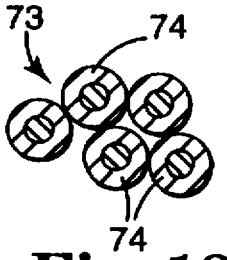
FIG. 18 is a schematic cross-section of a bundle of unbonded, contiguous, sheath-core filaments of this invention.
Figure 19:
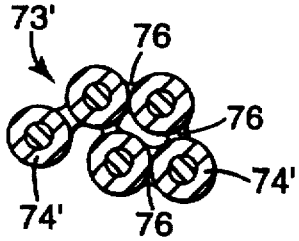
FIG. 19 is a schematic cross-section showing the bonding of the filaments of FIG. 18.
Figure 20:
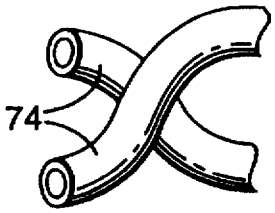
FIG. 20 is a schematic perspective view of portions of two unbonded contiguous sheath-core filaments of this invention.
Figure 21:
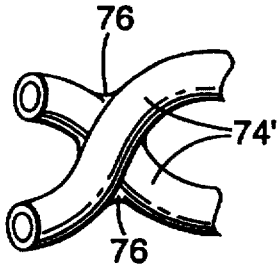
FIG. 21 is a schematic perspective view showing the bonding of the filaments of FIG. 20 at their points of contact.

FIG. 18 illustrates a bundle or aggregation 73 of bicomponent sheath-core filaments 74 (such as those shown in FIG. 7). FIG. 19 shows how the corresponding bundle of FIG. 18 looks upon melt-bonding, namely, bundle 73' which is made up of sheath-core filaments 74' in the bonded form, there being fillets 76 of the lower-melting sheath component formed at the points of contact. Similarly, FIG. 20 shows the exterior of the unbonded contiguous filaments 74 and FIG. 21 shows the exterior of the corresponding bonded filaments 74' with the fillets 76 formed at the points of contact thereof.

Figure 22:
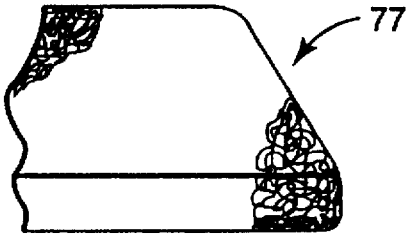
FIG. 22 is a schematic view in perspective of a portion of a filamentary matting of this invention.

FIG. 22 illustrates a mat 77 of this invention that can be cut from the finished webbing 43 of FIG. 1B.

Figure 23:
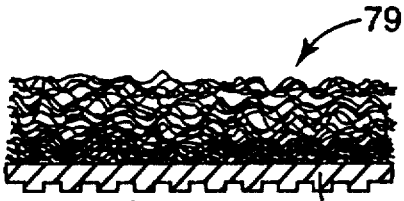
FIG. 23 is a schematic cross-section in elevation of a portion of a filamentary matting of this invention which is bonded to a backing.

FIG. 23 illustrates how the mat of FIG. 22 can be bonded on its lower surface to a backing 78 to form a backed or supported mat 79. The backing 78 can be a thermoplastic material which can be pre-embossed on its lower surface with a pattern, such as that shown, for example, to impart slip resistance to the mat 79.

Figure 24:
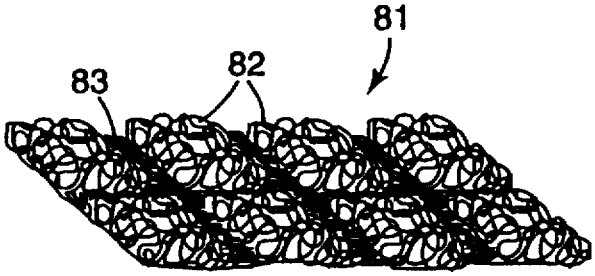
FIG. 24 is a schematic isometric view of a portion of a matting of this invention which is embossed on one side with a grid of channels.

FIG. 24 illustrates how the mat of FIG. 22 can be embossed on one surface to form an embossed mat 81 having raised portions 82 and recessed or depressed portions or channels 83, the dimensions of which raised and recessed portions can vary.

Figure 25:
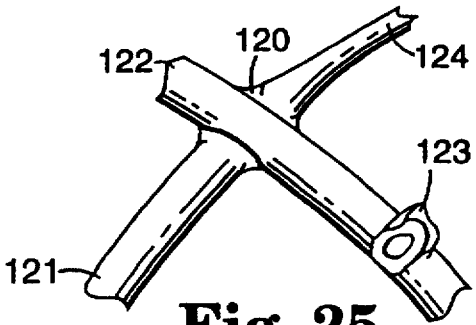
FIG. 25 is a schematic isometric view of a portion of bonded filaments of this invention showing a broken filament and the residue of a broken melt-bond.

FIG. 25 illustrates the toughness of the multicomponent filaments of this invention and the durable melt-bond obtained when an aggregation of the filaments are melt-bonded. In FIG. 25, a representative portion of such an aggregation of filaments are shown after they were melt-bonded and subjected to a pulling stress. Upon exerting such stress, some of the melt-bonds remained intact, as depicted by intact melt bond 120 between intersecting filaments 121 and 122, while other melt bonds broke, as depicted by the remnant 123 of a broken melt-bond, and some of the filaments broke, one of which, depicted as 124, attenuated before it broke.

Figure 26:
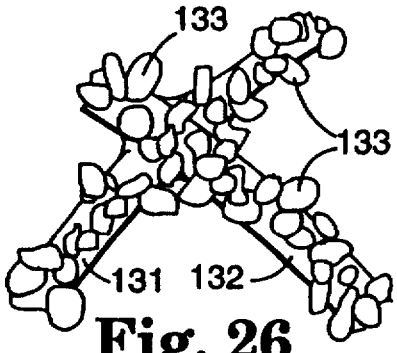
FIG. 26 is an isometric view of abrasive-coated filaments of this invention.

FIG. 26 illustrates two of the multicomponent filaments 131, 132 of this invention which can be covered or coated with abrasive mineral particulate or grains 133 bonded to the thermoplastic second component defining the surface of the filaments. An aggregation or web of such abrasive-coated filaments can be used as an abrasive pad or tool.

Thermoplastics (including blends of two or more thermoplastics) which can be used to prepare the multicomponent filaments of this invention are melt-extrudable, normally solid, synthetic organic polymers. The particular application of multicomponent filaments of this invention may dictate which melt-extrudable thermoplastics are selected therefor, based on their melting points. In addition to melting point as a selection guide, the desired toughness of a particular filament, and application thereof may also serve as a selection guide. Preferably the thermoplastic precursors can be melt-extruded into filaments that, when cooled and solidified, are tough in their undrawn state and do not embrittle upon subsequent thermal steps, such as melt-bonding, embossing, and backing. The level or degree of adhesion between the two components of the multicomponent filament at their interface (interfacial adhesion) is important to consider when selecting the type of polymer(s) for the sheath or core. While good interfacial adhesion is not necessary to achieve a tough, macrodenier, multicomponent filament, such adhesion may be desirable for abrasion resistance and toughness.

We have found that not all thermoplastics will be useful in making the tough multicomponent filaments of this invention. Specifically, common thermoplastics used to make drawn, bicomponent, textile fibers may not produce tough, macrodenier, multicomponent filaments in their undrawn state. For example, some polyethylene terephthalates and some polypropylenes, said to be useful in making drawn bicomponent binder fibers, have been found by us to produce undrawn, macrodenier, bicomponent fibers which are brittle and weak, thereby exhibiting poor flexibility and toughness.

Thermoplastics which can be used to prepare the multicomponent macrofilaments of this invention are preferably melt-extrudable above 38° C. and generally are filament-forming. The thermoplastics useful for second component must melt at a temperature lower than the melting point of first component (e.g. at least 15° C. lower). Furthermore, the thermoplastics for both first and second components are preferably those which have a tensile strength of 3.4 MPa or greater and elongation to break of 100% or greater, as measured by ASTM D882-90. Each of such thermoplastics is tough, preferably having a work of rupture, as defined by Morton and Hearle in *Physical Properties of Textile Fibers*, 1962, of $1.9\times10^7$ J/m$^3$ or greater, as measured from the area under the stress-strain curve generated according to ASTM D882-90 for both first and second components. Additionally, both components preferably have flex-fatigue resistance, or folding endurance, greater than 200 cycles to break, as measured according to ASTM D2176-63T; before and after heat aging or any melt-bonding step. The flex-fatigue resistance can be performed on a 15 mm×140 mm strip of film of the thermoplastic, as outlined in *Instruction Booklet No.* 64-10. Tinius Olsen Testing Machine Co., Easton Road, Willow Grove, Pa. As mentioned earlier, the filaments of this invention are durably melt-bondable. A simple test of the melt-bondability of the filaments, herein referred to as Filament Network Melt-Bond Strength Test, has been devised to measure such melt-bondability and is described below.

The Filament Network Melt-Bond Strength Test Employs a filament-supporting jig in the form of a 3 inch×4 inch×⅜ in (7.7 cm×10.2 cm×1 cm) rectangular block of aluminum, having a central rectangular opening extending from one face to the other and measuring 1¼ inch×2¼ inch (3.2 cm×5.7 cm). Eight straight grooves of equal length are cut in the top face of the block and extending from the central opening to the edges of the block to support a network to be formed by two sets of intersecting identical specimens or segments of a filament whose melt-bonded strength is to be measured and compared with that of the filament itself. One set of the grooves consists of a pair of parallel, longitudinally-cut grooves, ½ inch (1.2 cm) apart and deep enough to accommodate the width or diameter of the filament specimen placed therein and extending across the block from one edge thereof to the opening and in alignment with a second pair of line grooves extending from the opening to the opposing edge of the block. The other set of the grooves consist of two similar pairs of grooves, ¾ inch (1.5 cm) apart, extending transversely across the block from one edge to the opposing edge. The specimens of the filament to be melt-bonded are cut long enough to be laid into and extend beyond the grooves and each is pulled taut to remove slack (and without drawing) to form a network or grid (in the form of a "tic-tac-toe" figure) and maintained in that position with pieces of pressure-sensitive adhesive tape, e.g., masking tape, 1 inch (2.54 cm) wide. The filament-jig assembly is placed in a circulating-air oven and heated sufficiently to cause melt-bonds to form, one bond at each of the four points of intersection (over the central opening) of the specimens of filaments. The assembly is removed from the oven and allowed to stand at room temperature to cool and solidify the melt-bonds. The masking tape is then removed and the strength of the melt-bonds in the bonded filament network is then determined by using a Chatilion force gauge, type 719, and a stiff, round rod, such as a ¼ inch (0.5 cm) diameter pencil or wood dowel. The hook of the gauge is placed so as to grasp a first specimen at its center between the two melt bonds that bond it to two other specimens and permit the gauge to be pulled longitudinally by hand away from the network. The rod is placed vertically within the rectangle formed in the network and held against a second specimen opposite the first specimen and centrally between the two melt bonds that bond the second specimen to the two other specimens. With the gauge hook and rod so-positioned, the gauge is pulled until a melt bond or a network filament breaks, and the gauge reading is noted at the time of such break. This test is repeated 1–5 times with other specimens of the same filament and the gauge readings at break are recorded together with the nature of the breaks (i.e., melt-bond break or filament break). The average force is calculated. A durably melt-bonded filament has, as mentioned, a melt-bond whose breaking force exceeds 1.4 MPa, based on the cross-section area of the filament before breaking stress is applied.

Preferred properties of thermoplastic polymers useful as components of tough, undrawn, macrodenier, multicomponent filaments of this invention, e.g., sheath-core bicomponent filaments, are set forth in Table 1, together with test methods for determining such properties.

TABLE 1

| Material Property | First component | Second component |
|---|---|---|
| Melting Point, °C. (ASTM D2117) | at least 15° C. greater than melting point of Second component | >38° C. |
| Tensile Strength, MPa ASTM D882-90) | ≧3.4 | ≧3.4 |
| Elongation, % (ASTM D882-90) | ≧100 | ≧100 |
| Work of Rupture, J/m$^3$ (Morton and Hearle, loc. cit.) | ≧1.9 × 10$^7$ | ≧1.9 × 10$^7$ |
| Flex Fatigue Resistance, Cycles to Break (ASTM D2176-63T, modified to flex under 2.46 MPa constant stress) | >200 | >200 |

Melting temperature or point (the temperature that a material turns from a solid to a liquid), tensile strength at break, and elongation at break for the thermoplastics to be used in making the multicomponent filaments of this invention may be found in published information on the thermoplastics, such as vendor literature, polymer handbooks, or material databases. The tensile strength, elongation, toughness (work of rupture), and the flex-fatigue resistance of such thermoplastic can be determined on pressed, molded, or extruded film or sheet that has not been drawn and which has been heat aged at the desired melt-bonding temperature and time to be used in melt-bonding the filaments.

Examples of thermoplastic polymers which can be used to form the first and second components of the macrofilaments of this invention include polymers selected from the following classes, which preferably meet the criteria set forth in Table 1: polyolefins, such as polyethylenes, polypropylenes, polybutylenes, blends of two or more of such polyolefins, and copolymers of ethylene and/or propylene with one another and/or with small amounts of copolymerizable, higher, alpha olefins, such as pentene, methylpentene, hexene, or octene; halogenated polyolefins, such as chlorinated polyethylene, poly(vinylidene fluoride), poly (vinylidene chloride), and plasticized poly(vinyl chloride); copolyester-ether elastomers of cyclohexane dimethanol, tetramethylene glycol, and terephthalic acid; copolyester elastomers such as block copolymers of polybutylene terephthalate and long chain polyester glycols; polyethers, such as polyphenyleneoxide; polyamides, such as poly (hexamethylene adipamide), e.g., nylon 6 and nylon 6,6; nylon elastomers such as nylon 11, nylon 12, nylon 6,10 and polyether block polyamides; polyurethanes; copolymers of ethylene, or ethylene and propylene, with (meth)acrylic acid or with esters of lower alkanols and ethylenically-unsaturated carboxylic acids, such as copolymers of ethylene with (meth)acrylic acid, vinyl acetate, methyl acrylate, or ethyl acrylate; ionomers, such as ethylene-methacrylic acid copolymer stabilized with zinc, lithium, or sodium counterions; acrylonitrile polymers, such as acrylonitrile-butadiene-styrene copolymers; acrylic copolymers; chemically-modified polyolefins, such as maleic anhydride- or acrylic acid- grafted homo- or co-polymers of olefins and blends of two or more of such polymers, such as blends of polyethylene and poly(methyl acrylate), blends of ethylene-vinyl acetate copolymer and ethylene-methyl acrylate; blends of polyethylene and/or polypropylene with poly (vinyl acetate); and blends of thermoplastic elastomers such as styrene-ethylene- butylene -styrene block copolymers blended with ethylene vinyl acetate copolymer, ethyl meth-acrylate copolymers(optionally blended with a counterion such as zinc), ethylene propylene vinyl acetate terpolymer or ethylene-propylene copolymer. The foregoing polymers are normally solid, generally high molecular weight, and melt-extrudable such that they can be heated to form molten viscous liquids which can be pumped as streams to the extrusion die assembly and readily extruded therefrom under pressure as the multicomponent filaments of this invention. The same thermoplastic substance can serve as second component, e.g., a sheath, in one embodiment of the filaments and as first component, e.g., a core, in another embodiment of the filaments.

Examples of some commercially-available polymers useful in the practice of this invention are ethylene-vinyl acetate copolymers such those sold under the trade designation Elvax™, including Elvax™ 40W, 4320, 250, and 350 products or those sold under the trade designation AT (AT Plastics, Inc. of Charlotte, N.C.) including AT 1841 ethylene-vinyl acetate copolymer; EMAC™ ethylene methyl acrylate copolymer, such as EMAC™ DS-1274, DS-1176, DS-1278-70, SP 2220 and SP-2260 products; Vista Flex™ thermoplastic elastomer, such as Vista Flex™

641 and 671; Primacor™ ethylene-acrylic acid copolymers, such as Primacor™ 3330, 3440, 3460, and 5980 products; Fusabond™ maleic anhydride-g-polyolefin, such as Fusabond™ MB-110D and MZ-203D products; Himont™ ethylene-propylene copolymer, such as Himont™ KS-057, KS-075, and KS-051P products; FINA™ polypropylene, such as FINA™ 3860X or 95129 products; Escorene™ polypropylene such as Escorene™ 3445; Vestoplast™ 750 ethylene-propylene-butene copolymer; Surlyn™ ionomer, such as Surlyn™ 9970 and 1702 products; Ultramid™ polyamide, such as Ultramid™ B3 nylon 6 and Ultramid™ A3 nylon 6,6 products; Zytel™ polyamide, such as Zytel™ FE3677 nylon 6,6 product; Rilsan™ polyamide elastomer, such as BMNO P40, BESNO P40 and BESNO P20 nylon 11 products; Pebax™ polyether block polyamide elastomer, such as Pebax™ 2533, 3533, 4033, 5562 and 7033 products; Hytrel™ polyester elastomer, such as Hytrel™ 3078, 4056 and 5526 products; elastomeric block copolymers available under the trade designation KRATON (Shell Chemical Company) including KRATON G 1657 block copolymer. Blends of the foregoing polymers will comprise varying concentrations of the individual polymers within the first component as well as the second component. Blends of two or more polymers to form the first or second components of the filaments of this invention may be used to modify material properties so that the components meet the performance targets required for a particular application.

Certain blends of synthetic thermoplastic polymers have been found to possess synergistic flex-fatigue resistance and/or synergistic thermal bonding properties, making them particularly useful as sheath components in a sheath/core fiber. Such blends have properties, including the properties listed in Table 1, that are surprisingly superior to the corresponding properties of the individual thermoplastic polymers in the blends. The blends can be prepared by simple mixing of certain thermoplastic polymers in the appropriate ratios. One blend of polymers useful to form a sheath of a sheath-core bicomponent fiber is a blend of (1) 5 to 75 wt % a block copolymer comprised of styrene, ethylene and butylene as a first synthetic thermoplastic polymer with (2) 95 to 25 wt % ethylene vinyl acetate copolymer. Suitable ethylene vinyl acetate materials include those commercially available as Elvax™ copolymer or AT 1841 copolymer.

The block copolymer typically comprises between about 1 and 20 wt % styrene and can be a blend of a triblock polymer of styrene-ethylene-butylene-styrene and a diblock polymer of styrene-ethylene-butylene wherein the relative amount of the triblock exceeds that of the diblock. Most preferably, the block copolymer comprises about 70% by weight of the triblock polymer blended with about 30% by weight of the diblock polymer. A preferred commercially available block copolymer is that available under the trade designation KRATON G 1657. Additionally, blends of the block copolymer at the foregoing weight percentages may be blended with other materials (e.g., other second synthetic thermoplastic polymers) to provide a second component in a multicomponent fiber or filament according to the present invention. Materials suitable for blending with the foregoing block copolymer include ethyl methacrylate copolymer blended with a zinc counterion (e.g., "Surlyn" copolymer), ethylene-propylene copolymer (e.g., FINA 95129 material), ethylene methyl acrylate copolymer (e.g., EMAC SP 2220 material), ethylene propylene vinyl acetate terpolymer (e.g., "VistaFlex" 671-N thermoplastic elastomer), acid modified ethylene vinyl acetate copolymer (e.g., BYNEL CXA 2022 material) and the like. In addition to their use as fiber components, the foregoing blends are also useful in the manufacture of matting wherein blends of the materials can be used as sheath components in bicomponent fibers and as a sheet material useful as a backing for such matting, for example.

Blends of the foregoing block copolymer with the foregoing second synthetic thermoplastic copolymer materials exhibit enhanced self bonding when compared with the self bonding characteristics of the individual component materials. In other words, two fibers, each comprised of the block copolymer blended with, for example, an ethylene vinyl acetate copolymer can be thermally bonded to one another, as is described elsewhere herein. The strengths of the thermal bond for fibers comprised of the forgoing blends exceed the thermal bond strengths for fibers consisting solely of the block copolymer material or solely of the ethylene vinyl acetate copolymer. It is known that the ability of the block copolymer to thermally bond to itself is poor, while the ability of the above mentioned thermoplastic materials (e.g., ethyl methacrylate copolymer comprising a zinc counterion, ethylene-propylene copolymer, ethylene methyl acrylate copolymer, ethylene propylene vinyl acetate terpolymer, acid modified ethylene vinyl acetate copolymer) to self bond may be somewhat better. Based on relative bonding characteristics, it might be expected that the blend of first and second synthetic thermoplastic polymers will have a thermal bond strength between the bond strengths for the individual components. Surprisingly and unexpectedly, it has been found that the bond strengths for the foregoing blended components far exceed such predications.

Some materials are also well suited for use as a core component (e.g., a first component) in a sheath core filament because of superior resistance to flex fatigue and excellent bonding to a sheath component. An especially preferred blend of materials for forming the core of sheath-core filament which provides highly superior flex fatigue properties is a blend of 10 to 70 wt % poly(ethylene-propylene-butene) terpolymer having $M_w$ of 40,000 to 150,000 and derived from equally large amounts of butene and propylene and a small amount of ethylene with 90 to 30 wt % isotactic polypropylene. A commercially available ethylene-propylene-butene terpolymer known under the trade designation Vestoplast™ 750 is an example of a preferred component for use in this aspect of the invention.

The above-described synergistic blends also have utility in the form of film, tapes, or tubing, which involve no heat-bonding, and the blends can also be used as heat-bonding film. The multicomponent filaments of this invention and/or articles incorporating such filaments may be modified by a number of post-extrusion operations to further enhance utility. Some examples of such operations are the following.

Hot Quench Bath Process (For Melt-Bonding)

In the preparation of articles incorporating the macrodenier, multicomponent filaments of this invention, the temperature of the quench bath described above, e.g., in FIGS. 1A and 1B, may be an elevated temperature to permit durable melt-bonding of the filaments, thus eliminating the need for a thermal bonding step after the filaments are withdrawn from the quench bath. Because of the multicomponent nature of the filaments of this invention, the quench medium in this operation can be heated to a temperature above the melting point of second component but below that of first component. If the web of such filaments is maintained at this temperature, the tackiness or flowability of the still hot second component of the filaments is retained, while the now essentially-solidified first component provides dimensional stability to the filaments, and, as a result, second component has time to melt-bond at the initial tack-bonding sites and provide similar if not equal strength to that achieved in a post-quench thermal bonding step that otherwise would be necessary for durable melt bonding. In contrast, single component filaments cannot be heated to these elevated quench temperatures without seriously distorting or destroying their as-quenched, tack-bonded filamentary structure obtained at lower quench temperatures. This operation, wherein the quench medium can both quench and simultaneously permit melt-bonding, does away with the need for additional bonding step(s). The bath medium for this operation can be selected to match the various filament components and their melt temperatures. The medium may be water or other heat-exchange fluids, such as inert silicone oil or inert fluorochemical fluids. The bath for this operation may be heated by a variety of methods, e.g., electrical immersion heaters, steam, or other liquid heat-exchange means. For example, steam heat may be used to heat a water quench bath to a temperature below the boiling point of water but to a temperature hot enough to melt thermoplastics like polyvinylacetate when used for second component of the filaments, while nylon 6 may be used for first component which will be quenched at these temperatures. The time and temperature that a web of such multicomponent filaments experiences in the elevated-temperature bath will also affect interfilament bond strength. In conveying the web through the elevated-temperature quench medium and any associated rolls and guiding devices, it may be desirable or necessary to support the web continuously through the medium. It may also be advantageous to add a further cooling station to satisfactorily cool the heated web prior to any additional conveying, handling, or processing.

Embossing Webs

Embossing the melt-bonded, open, nonwoven webs of the macrodenier, multicomponent filaments of this invention is another way of providing a change in either the surface appearance of a web article or in the functionality of the article. Embossing the web article can change the physical appearance of the structure, e.g., by adding a recessed grid pattern or message (e.g., "THINK SAFETY") or a flattened edge to a mat. Additionally, articles comprising the filaments can be embossed by passing such an article between patterned or embossing rolls while the article is still hot and soft from the melt-bonding step and before it is completely cooled. Such an embossed article is shown in FIG. 24. This embossing operation may be utilized to reinforce a web of the multicomponent filaments in both the machine direction and cross direction. The multicomponent filament nature of the webs considerably improves the ease by which embossing for a nonwoven filamentary web may be achieved. Embossing a pattern may comprise heating a multicomponent filament web (without undue distortion or collapse of the web) and then imparting the pattern from a suitably-shaped platen under pressure which also functions to cool the hot web. Alternatively, a heated platen can be used to locally soften and compress a cool web without distorting the remaining uncompressed and unheated web. Desired patterns of either a continuous or discontinuous nature can be embossed readily without the need for an additional and later reheating step and without undesired collapse of the web structure.

In one method of forming such a patterned web, the above-described Hot Quench Bath Process can be utilized in conjunction with a pair of patterned or embossing rolls that are located after web formation so as to pattern the so-formed web while second component of the multicomponent filaments thereof is still hot and tacky and while the web is still easily deformable but yet bonded. This method isolates the web-embossing step from the web-formation step where any excessive surface or wave motion of the bath, that could arise from complex patterns of a surface embossing roll interacting with the bath surface interface, would ultimately cause the resulting web to be nonuniform. The embossing rolls may be contained within the quench bath or may even be located outside of the quench bath but impart their patterning while the web is still hot and before it is cooled to ambient conditions. A patterned web may also be formed by embossing bonded web emerging from a hot air-bonding oven (in cases where hot bath-bonding may not be desirable) with an embossing roll, which typically will be chilled Because of the multicomponent filament nature of the web, web temperatures higher than the collapse temperature of second component of the filaments can be achieved so that embossing with excellent flow characteristics can be accomplished without undesired web collapse or distortion. This process patterning would be much more difficult if not impossible with single component fibers that require bonding with an additional bonding agent(s) and web collapse would be a limiting factor.

Foaming Multicomponent Filaments

By dispersing a chemical blowing agent, such as azodicarabonamide, sodium bicarbonate, or any other suitable gas-generating or foam-inducing agent, physical or chemical, to a composition used to form a component of the macrodenier, multicomponent filaments of this invention, a foamed or cellular structure can be imparted to some or all of the components of the filaments. Such foaming may be used to alter the material properties (e.g., resiliency, specific gravity, adsorption characteristics, antislip properties, etc.) of the articles made from the foamed or cellular multicomponent filaments. Such foaming may tend to swell the thickness of the individual filaments as well as the overall thickness of webs formed from these filaments. A surprising and unexpected result of macrodenier, multicomponent filaments of this invention with foamed cores is the superior tensile strength of webs formed from such foamed filaments as compared to web made with unfoamed multicomponent filaments.

Laminating

The macrodenier, multicomponent filaments or webs of this invention may be laminated to one or more preformed elements or backing, such as thermoplastic films or sheets. These elements can be solid or porous (in the case of a foamed film). The backing may act as an impervious barrier to either particulates or fluids as in the case of backed floor mats of open, nonwoven webs of the multicomponent filaments, or the backing may act as a reinforcing agent imparting dimensional stability to such mats. The melt-bondable nature of the multicomponent filaments of this invention is particularly useful in achieving their excellent self-bonding to such backings without the need for additional bonding agents. The bonding and laminating temperatures can be sufficient to cause the filaments to become hot and tacky to allow fusion between the backing and filaments while the first component of the filament is above the melt-bonding temperature.

Although not restricted to like materials, better bonding may be achieved between similar materials, that is, when the laminated backing is comprised of the same materials as the second component of the multicomponent filament of this invention. Hence, a preferred backing is one comprised of at least one or more of the same polymeric materials as are present in the second or thermal bonding component of the filament. Such backings may include these same materials at different concentrations than in the second component of the filament.

In this regard, blends comprised of 5 to 75 wt % of the foregoing KRATON G 1657 block copolymer with 95 to 25 wt % of a thermoplastic polymer are suitable in the formation of a backing for matting. Thermoplastic polymers suitable in such blends include AT 1841 ethylene vinyl acetate, SURLYN ethylene methacrylate with a zinc counterion, FINA 95129 ethylene-propylene copolymer, Escorene™ 3445 polypropylene, EMAC SP 2220 ethylene methyl acrylate copolymer. These blends are especially preferred when bonding with a second component in a multicomponent filament comprised of the same materials. Other materials suited for use as backings include films of polypropylene, ethylene vinyl acetate copolymer (e.g., "AT 1841" material) by itself or blended with ethylene propylene copolymer (e.g., FINA 95129 material), ethylene propylene copolymer (e.g., FINA 95129 material) by itself, ethylene methacrylate copolymer comprising a zinc counterion (e.g., SURLYN 1702 material), and ethylene methyl acrylate copolymer (e.g., EMAC SP 2220 material). These materials are especially useful as backings in matting comprised of multicomponent melt bondable filaments wherein the second component of the filaments is thermally bonded to the backing and wherein the second component comprises a block copolymer blended with a thermoplastic polymer, as described elsewhere herein. Some preferred combinations of materials are illustrated in the Examples herein. These combinations of materials represent both a backing material and a melt bondable portion of a multicomponent filament.

Still another preferred backing is one comprised of a blend of 10 to 70 wt % poly(ethylene-propylene-butene) terpolymer having $M_W$ of 40,000 to 150,000 and derived from equally large amounts of butene and propylene and a small amount of ethylene with 90 to 30 wt % isotactic polypropylene. The above mentioned Vestoplast™ 750 ethylene-propylene-butene terpolymer is a suitable component for use in this aspect of the invention.

The backing may be embossed, prior to lamination, with a secondary pattern. For example, raised pegs or projections may be added to impart a texture or frictional aspect to the backing or the backing may be embossed as a result of a pattern transferred from a supporting carrier web, for example, a metal grid or mesh, that carries the backing and web through a melt-bonding oven to produce a backed web as described hereinabove and shown in FIG. 23.

The backing may also be thermoformed prior to lamination. The lamination may be carried out by a variety of methods, such as illustrated in FIG. 1C.

In another lamination process, such as shown in FIG. 1D, a cool preformed backing may be used instead of the cast backing illustrated in FIG. 1C, and sufficient tack- bonding can be developed between the cool backing and the web to allow the laminate to be conveyed to the bonding oven where durable melt-bonding can be achieved. Alternatively, the Hot Quench Bath Process described above can be used to durably melt-bond multicomponent filaments of the laminate.

In another lamination process, a preformed thermoplastic backing may be positioned below the web just prior to the melt-bonding oven, whereby the weight of the web in contact with the backing is sufficient to obtain the durable melt-bond of the web-backing laminate. These laminations can be considered to be ambient lamination without any undesired or added pressures, but these laminations can also be formed using compressive forces to deform hot webs so as to form additional embossing (described herein) in combination with laminating process.

Abrasive Articles

Abrasive articles can be made using the macrodenier, multicomponent filaments of this invention or webs thereof. These articles can be used for abrasive cutting or shaping, polishing, or cleaning of metals, wood, plastics, and the like. Additionally, coating abrasive particulate or grains on the multicomponent filament surfaces can provide antislip or friction. Current methods of creating an abrasive article as taught in U.S. Pat. No. 4,227,350, for example, typically rely on first coating a suitable substrate with a durable binder resin and, while it is still tacky, then coating thereon abrasive particles or other materials, and finally curing the abrasive or antislip composite structure to achieve durability, toughness, and functionality. Such a process typically requires high performance resin systems that contain solvents and other hazardous chemicals that necessitate additional careful monitoring to ensure adequate cure with minimization of residual ingredients as well as sophisticated pollution control schemes to control harmful solvent emissions. The tough, multicomponent filaments of this invention allow simplification to the overall abrasive- or particle-holding binder systems by elimination of solvent-coating techniques, the ability to use 100% solids systems instead, and elimination even of the need for additional bonding agent in the cases where a prebond resin system must be used prior to any abrasive binder resin system. The multicomponent filaments of this invention can simultaneously provide bonding and "make coat" capability. Materials suitable for the abrasive particulate component can be granules of regular or irregular shape, of virtually any size, and selected from a broad variety of classes of natural or synthetic, abrasive, mineral particulate, such as silicon carbide, aluminum oxide, cubic boron nitride, ceramic beads or grains such as Cubitron™ abrasive materials, and plastic abrasive grains, as well as agglomerates of one or more of these materials. The ultimate use of the abrasive article will determine what materials are suitable for second component of the multicomponent filament of such article.

Different methods of applying or coating the abrasive particulate on or to the filaments or webs of this invention can be used. Because of the multicomponent nature of the filaments of this invention, the higher melting point first component thereof allows structural integrity of the filaments while allowing second component to retain its hot, tacky nature when the filaments are heated in a melt-bonding oven. By sprinkling, dropping, blowing or otherwise coating the abrasive particulates onto the hot, tacky surface of the filaments, the particulates will adhere to such surface. Depending on the heat capacity, crystallinity, and melting point of second component, adhesion of room temperature or cool abrasive particulates can occur. Enhanced adhesion can occur when abrasive mineral particulate is preheated prior to dropping onto the hot second component surface such that localized cooling is minimized. Adhesion to higher melting point thermoplastics is especially enhanced by preheating the abrasive mineral. In addition, surface treatments of the abrasive particulates may also enhance adhesion, for example, by a silane surface treatment. Another method of coating filaments or webs of this invention is passage of either the filaments or previously prebonded webs thereof into a fluidized bed of heated abrasive mineral particulate. This process has the particular advantage of more forcefully pushing the hot abrasive mineral into heated second component. After cooling, the abrasive particulates are adhered onto and into second component. A further size coat of suitable resin, such as a polyurethane or resole phenolic resin, may be used to further lock the abrasive particulate to the surface of the multicomponent filament or webs thereof.

Filamentary Structures

The multicomponent nature of the filaments of this invention may also be advantageously used to enhance bonding when articles or webs in the form of filamentary structures, for example, as generally taught by U.S. Pat. Nos. 4,631,215 (Welygan et al.), U.S. Pat. No. 4,634,485, and U.S. Pat. No. 4,384,022 (Fowler) are fabricated from both straight and undulating or spiral filaments. Bonding occurs when the undulating or spiraling, hot, extruded, multicomponent filaments contact adjacent straight filaments and then are quenched in a cooling bath to retain the shape of the so-formed filamentary structure. The multicomponent nature of the filaments provides an unexpected advantage by allowing first component thereof to provide a structural role in supporting the shape of the web of such filaments in either a post-formation melt-bonding step or by utilizing the above-described Hot Quench Bath Process without the need for any additional process steps. In this fashion a tough, durable web of filamentary structure of multicomponent filaments can be prepared.

Fire Retardancy

As mentioned, fire retardant additives may be incorporated or dispersed in the filaments of this invention. Examples of such additives are ammonium polyphosphate, ethylenediamine phosphates, alumina trihydrate, gypsum, red phosphorus, halogenated substances, sodium bicarbonate, and magnesium hydroxide. Such additives can be blended with the particulate thermoplastic precursor of components (a) and/or (b) of the filaments of this invention or can be added to the melts thereof in the melt extruders used to prepare them. Preferably such additives, where used to impart fire retardancy to filaments of this invention, are incorporated only in a first component which does not have an external surface that defines the material-air boundary of the filaments such as the core of bicomponent sheath-core filaments. By so-incorporating the fire retardant additive in the core of the filament, the melt-bonding capability of the sheath, second component, and thus the durability of the resulting melt-bonded structure, remain uncompromised, even if a high amount of the fire retardant additive is used. The particular fire retardant additive used for this purpose and the amount thereof to be incorporated will depend upon the particular filament to be made fire retardant, the particular thermoplastics thereof, and the application to be made of the filament. Generally, the amount of fire retardant additive, such as magnesium hydroxide, will be 10 to 40 wt % or more, based on the total weight of the fire retardant additive and filament or, functionally stated, an amount sufficient to render the filament fire retardant as determined by ASTM D-2859-76.

| MATERIALS | |
|---|---|
| KRATON G 1657 | is the trade designation for a block copolymer comprising a blend of 30 wt % diblock polymer of polystyrene and ethylene butylene (SEB) and 70 wt % triblock polymer of polystyrene-ethylene-butylene-polystyrene (SEBS) available from Shell Chemical Company, Houston, Texas. |
| AT 1841 | is the trade designation for an ethylene vinyl acetate (EVA) copolymer available from AT Plastics, Inc. of Charlotte, North Carolina. |
| VISTAFLEX 671-N | is the trade designation for a ethylene propylene vinyl acetate terpolymer available from Advanced Elastomer Systems of St. Louis, Missouri. |
| BYNEL 3101 | is the trade designation for an acid modified ethylene vinyl acetate polymer available from E.I. DuPont de Nemours of Wilmington, Delaware. |
| EMAC SP 2220 | is the trade designation for ethylene methyl acrylate copolymer available from Chevron Chemical Company, of Houston, Texas. |
| BYNEL CXA 2022 | is tbe trade designation for an acid modified ethylene vinyl acetate polymer available from E.I. DuPont Day Nemours, of Wilmington, Delaware. |
| FINA 95129 | is the trade designation for an ethylene-propylene copolymer commercially available from Fina Oil and Chemical Company of Schaumburg, Illinois. |
| SURLYN 1702 | is the trade designation for an ethyl methacrylate copolymer blended with a zinc counterion commercially available from E.I. DuPont de Nemours of Wilmington, Delaware. |
| PP 3445 | is the trade designation for isotactic polypropylene commercially available from Exxon Chemical Company of Houston, Texas. |

PROCEDURES

Procedure A: Sample Preparation

Films were prepared by extruding molten material through a film dye approximately ten inches (25.4 cm) in width. The molten material was picked up from the extruder by a quenching roll with cooling water circulating therethrough. The cooled films were wound up and allowed to equilibrate at ambient conditions for a minimum of 24 hours. Resulting film thickness' were between 0.01 inch (0.0254 cm) and 0.03 inch (0.0762 cm). Strips of the film were cut to measure 2 inch (5.1 cm) by 8 inch (20.3 cm). Pairs of these films strips were then laid on top of one another and placed on a conventional cooking sheet (coated with a non-stick coating). Between each pair of thermal plastic films strips, a suitable separator was inserted at one end. The separator was chosen for its non-bonding properties with the materials within each of the film strip pairs. The separator film measured approximately 2 inch by 2 inch (5.1×5.1 cm) and was typically less than 0.005 inch (0.013 cm) thick. A brass plate weighing approximately 0.22 lbs (0.1 kg) and measuring 2 inch×8 inch by 0.024 inch (5.1×20.3×0.06 cm) was placed on top of the two film strips with the separator strip inserted therebetween. The strips and brass plate were placed into a circulating air oven and heated for 5 minutes at 305° F. (152° C.). After 5 minutes, the composite was removed from the oven and allowed to cool for 24 hours at ambient conditions. There after, the brass plate and film were removed from the cooking sheet and a 0.5 inch (1.27 cm) wide strip was cut along the length of the thermally bonded specimen for use in the thermal bonding test described herein.

Procedure B: Thermal Bonding Test

Samples prepared according to the above Procedure A were used to evaluate the ability of the materials in the films to thermally bond to one another. The separator was first removed from between the two films. The sample comprised the two thermally bonded strips wherein one end of the bonded strips included the unbonded ends of the original film materials where the separator had been inserted. These ends were positioned in the tension jaws of a tensile testing machine (commercially available under the trade designation "Sintech 2", model number T30-88-125 available from MTS Systems Corporation of North Carolina). The instrument was set to provide a jaw head speed of 10 inches per minute (25.4 cm per minute). The two bonded films in each sample were pulled apart from one another, and the average separation force was measured when the jaw head separation was between one inch (2.54 cm) and 6 inches (15.24 cm). The separation force is reported in pounds-force (lbsF) and Newtons (N).

EXAMPLES

The following examples are meant to be illustrative of this invention and objects and advantages thereof, and should not be construed as limiting the scope of this invention. The measurement values given in these examples are generally average values except where otherwise noted.

Example 1 and Comparative Examples A and B

Samples comprised of the materials set forth in Table 2 were prepared according to the above Preparative Procedure A and tested according to the Preparative Procedure B. The samples of Example 1 unexpectedly showed a synergy in thermal bonding when compared to the individual component films of Comparative Examples A and B.

TABLE 2

| Sample | Composition | Thermal Bonding |
|---|---|---|
| Ex. 1 | 75% ethylene-propylene copolymer[1] 25% block copolymer[2] | 5 lbsF (22.2 N) |
| C. Ex. A | ethylene-propylene copolymer | no bonding |
| C. Ex B | block copolymer | no bonding |

[1]FINA 95129 copolymer.
[2]KRATON G 1657 block copolymer.

Example 2 and Comparative Examples B and C

Samples comprised of the materials set forth in Table 3 were prepared according to the above Preparative Procedure A and tested according to the Preparative Procedure B. The samples of Example 2 unexpectedly showed a synergy in thermal bonding when compared to the individual component films of Comparative Examples B and C.

TABLE 3

| Sample | Composition | Thermal Bonding |
|---|---|---|
| Ex. 2 | 75% EVA[1] 25% block copolymer[2] | 3.5 lbsF (15.6 N) |
| C. Ex. C | EVA | 2.5 lbsF (11.1 N) |
| C. Ex B | block copolymer | no bonding |

[1]AT 1841 ethylene vinyl acetate copolymer
[2]KRATON G 1657 block copolymer

Example 3 and Comparative Examples B and D

Samples comprised of the materials set forth in Table 4 were prepared according to the above Preparative Procedure A and tested according to the Preparative Procedure B. The samples of Example 3 unexpectedly showed a synergy in thermal bonding when compared to the individual component films of Comparative Examples B and D.

TABLE 4

| Sample | Composition | Thermal Bonding |
|---|---|---|
| Ex. 3 | 75% ethyl methacrylate (w/ Zn counterion[1]) 25% block copolymer[2] | 2.5–3.0 lbsF (11.1–13.3 N) |
| C. Ex. D | ethyl methacrylate w/ Zn counterion | no bonding |
| C. Ex B | block copolymer | no bonding |

[1]SURLYN 1702 copolymer
[2]KRATON G 1657 block copolymer

A series of samples were prepared to determine whether blending a block copolymer (KRATON G 1657) with various polymer materials provided enhanced bonding to dissimilar materials.

Example 4 and Comparative Example E

Film laminates were prepared according to the above Procedure A and evaluated for thermal bonding according to the Procedure B. Example 4 comprised a laminate of (1) 75% EVA (AT 1841 copolymer) blended with 25% block copolymer (KRATON G 1657 material) and bonded to (2) a blend 75% isotactic polypropylene (PP 3445 material) blended with 25% block copolymer (KRATON G 1657 material). Comparative Example E comprised a laminate of 100% EVA (AT 1841 copolymer) bonded to a film of the same blend of polypropylene and block copolymer. Thermal bonding of Example 4 was 2.32 lbsF (10.3N) and 0.99 lbsF (4.4N) for Comparative E, indicating enhance bonding for the blend of Example 4.

Example 5 and Comparative Example F

Film laminates were prepared according to the above Procedure A and evaluated for thermal bonding according to the Procedure B. Example 5 comprised a laminate of (1) 75% EVA (AT 1841 copolymer) blended with 25% block copolymer (KRATON G 1657 material) and bonded to (2) a film of 100% ethylene-propylene copolymer (FINA 95129 material). Comparative Example F comprised a laminate of 100% EVA (AT 1841 copolymer) bonded to a film of the same ethylene-propylene copolymer. Thermal bonding of Example 5 was 2.38 lbsF (10.6N) with no thermal bond for the sample of Comparative Example F, indicating enhance bonding for the blend of Example 5.

Example 6 and Comparative Example G

Film laminates were prepared according to the above Procedure A and evaluated for thermal bonding according to the Procedure B. Example 6 comprised a laminate of (1) 75% ethylene methyl acrylate copolymer (EMAC 2220 material) blended with 25% block copolymer (KRATON G 1657 material) and bonded to (2) a film of 100% ethylene-propylene copolymer (FINA 95129 material). Comparative Example G comprised a laminate of 100% ethyl methacrylate copolymer bonded to a film of the same ethylene-propylene copolymer. Thermal bonding of Example 6 was 2.21 lbsF (9.83N) with no thermal bond for the sample of Comparative Example G, indicating enhance bonding for the blend of Example 6.

Example 7 and Comparative Example H

Film laminates were prepared according to the above Procedure A and evaluated for thermal bonding according to the Procedure B. Example 7 comprised a laminate of (1) 75% ethylene propylene vinyl acetate terpolymer ("VistaFlex" 671-N material) blended with 25% block copolymer (KRATON G 1657 material) and bonded to (2) a film of 100% ethylene-propylene copolymer (FINA 95129 material). Comparative Example H comprised a laminate of 100% ethylene propylene vinyl acetate terpolymer bonded to a film of the same ethylene-propylene copolymer. Thermal bonding of Example 7 was 1.43 lbsF (6.36N) with no thermal bond for the sample of Comparative Example H, indicating enhance bonding for the blend of Example 7.

Example 8 and Comparative Example I

Film laminates were prepared according to the above Procedure A and evaluated for thermal bonding according to the Procedure B. Example 8 comprised a laminate of(1) 75% EVA (AT 1841 copolymer) blended with 25% block copolymer (KRATON G 1657 material) bonded to (2) 75% ethylene-propylene copolymer (FINA 95129 material) blended with 25% block copolymer (KRATON G 1657 material). Comparative Example I comprised a laminate of 100% EVA bonded to a film of the same ethylene-propylene copolymer blended with the same block copolymer material. Thermal bonding of Example 8 was 3.31 lbsF (14.7) and less than 0.5 lb for the sample of Comparative Example I, indicating enhance bonding for the blend of Example 8.

Example 9 and Comparative Example J

Film laminates were prepared according to the above Procedure A and evaluated for thermal bonding according to the Procedure B. Example 9 comprised a laminate of (1) 75% ethylene methyl acrylate copolymer (EMAC SP 2220 material) blended with 25% block copolymer (KRATON G 1657 material) bonded to (2) 75% ethylene-propylene copolymer (FINA 95129 material) blended with 25% block copolymer (KRATON G 1657 material). Comparative Example J comprised a laminate of 100% ethyl methacrylate bonded to a film of the same ethylene-propylene copolymer blended with the same block copolymer material. Thermal bonding of Example 9 was 2.89 lbsF (12.8N) and about 2.0 lb for the sample of Comparative Example J, indicating enhance bonding for the blend of Example 9.

Example 10 and Comparative Example K

Film laminates were prepared according to the above Procedure A and evaluated for thermal bonding according to the Procedure B. Example 10 comprised a laminate of (1) 75% ethylene propylene vinyl acetate terpolymer ("VistaFlex" 671-N material) blended with 25% block copolymer (KRATON G 1657 material) bonded to (2) 75% ethylene-propylene copolymer (FINA 95129 material) blended with 25% block copolymer (KRATON G 1657 material). Comparative Example K comprised a laminate of 100% ethylene propylene vinyl acetate terpolymer to a film of the same ethylene-propylene copolymer blended with the same block copolymer material. Thermal bonding of Example 10 was 1.69 lbsF (7.15N) with no bonding for the sample of Comparative Example K, indicating enhance bonding for the blend of Example 10.

Example 11 and Comparative Example L

Film laminates were prepared according to the above Procedure A and evaluated for thermal bonding according to the Procedure B. Example 11 comprised a laminate of (1) 75% ethyl methacrylate with Zinc as a counterion (SURLYN copolymer) blended with 25% block copolymer (KRATON G 1657 material) bonded to (2) 100% ethyl methacrylate with Zinc as a counterion (SURLYN copolymer). Comparative Example L comprised a laminate of 100% of the same ethyl methacrylate copolymer to a second film of the same ethyl methacrylate copolymer. Thermal bonding of Example 11 was 1.99 lbsF (8.85N) with no bonding for the sample of Comparative Example L, indicating enhance bonding for the blend of Example 11.

Example 12 and Comparative Example M

Film laminates were prepared according to the above Procedure A and evaluated for thermal bonding according to the Procedure B. Example 12 comprised a laminate of (1) 75% acid modified ethylene vinyl acetate polymer (BYNEL CXA 2022 copolymer) blended with 25% block copolymer (KRATON G 1657 material) bonded to (2) 100% ethyl methacrylate with Zinc as a counterion (SURLYN copolymer). Comparative Example M comprised a laminate of 100% of the same acid modified ethylene vinyl acetate polymer to a second film of the same SURLYN copolymer. Thermal bonding of Example 12 was greater than 5.7 lbsF (25.4N) and 3.4 lbsF (15.1N) for the sample of Comparative Example M, indicating enhance bonding for the blend of Example 12.

Example 13 and Comparative Example N

Film laminates were prepared according to the above Procedure A and evaluated for thermal bonding according to the Procedure B. Example 13 comprised a laminate of (1) 75% acid modified ethylene vinyl acetate polymer (BYNEL CXA 2022 copolymer) blended with 25% block copolymer (KRATON G 1657 material) bonded to (2) 75% ethyl methacrylate with Zinc as a counterion (SURLYN copolymer) blended with 25% block copolymer (KRATON G 1657 material). Comparative Example N comprised a laminate of 100% of the same acid modified ethylene vinyl acetate bonded to a film of 75% ethyl methacrylate with Zinc as a counterion (SURLYN copolymer) blended with 25% block copolymer (KRATON G 1657 material). Thermal bonding of Example 13 was greater than 5.25 lbsF (23.3N) and 4.55 lbsF (20.2N) for the sample of Comparative Example N, indicating enhance bonding for the blend of Example 13.

Example 14 and Comparative Example O

Film laminates were prepared according to the above Procedure A and evaluated for thermal bonding according to the Procedure B. Example 14 comprised a laminate of (1) 75% acid modified ethylene vinyl acetate polymer (BYNEL CXA 2022 copolymer) blended with 25% block copolymer (KRATON G 1657 material) bonded to (2) 100% ethylene methyl acrylate copolymer (EMAC SP 2220 material). Comparative Example O comprised a laminate of 100% of the same acid modified ethylene vinyl acetate bonded to a film of the same ethyl methacrylate. Thermal bonding of Example 14 was 1.23 lbsF (5.47N) with no observed bonding for the sample of Comparative Example O, indicating enhance bonding for the blend of Example 14.

Example 15 and Comparative Example P

Film laminates were prepared according to the above Procedure A and evaluated for thermal bonding according to the Procedure B. Example 15 comprised a laminate of (1) 75% ethylene propylene vinyl acetate terpolymer ("VistaFlex" 671-N thermoplastic elastomer) blended with 25% block copolymer (KRATON G 1657 material) bonded to (2) 100% ethylene methyl acrylate copolymer (EMAC SP 2220 material). Comparative Example P comprised a laminate of 100% of the same ethylene propylene vinyl acetate terpolymer bonded to a film of the same ethyl methacrylate. Thermal bonding of Example 15 was 2.08 lbsF (9.85N) and less than 1.0 for the sample of Comparative Example P, indicating enhance bonding for the blend of Example 15.

Example 16 and Comparative Example Q

Film laminates were prepared according to the above Procedure A and evaluated for thermal bonding according to the Procedure B. Example 16 comprised a laminate of (1) 75% ethylene propylene vinyl acetate terpolymer ("VistaFlex" 671-N material) blended with 25% block copolymer (KRATON G 1657 material) bonded to (2) 75% ethylene methyl acrylate copolymer (EMAC SP 2220 material) blended with 25% block copolymer (KRATON G 1657 material). Comparative Example Q comprised a laminate of 100% of the same ethylene propylene vinyl acetate terpolymer bonded to a film 75% ethylene methyl acrylate copolymer (EMAC SP 2220 material) blended with 25% block copolymer (KRATON G 1657 material). Thermal bonding of Example 16 was 2.17 lbsF (9.65N) and 1.35 lbsF (6.0N) for the sample of Comparative Example Q, indicating enhance bonding for the blend of Example 16.

Example 17 and Comparative Example R

Film laminates were prepared according to the above Procedure A and evaluated for thermal bonding according to the Procedure B. Example 17 comprised a laminate of (1) 75% ethylene vinyl acetate copolymer ("AT 1841" material) blended with 25% block copolymer (KRATON G 1657 material) bonded to (2) isotactic polypropylene ("PP 3445" material). Comparative Example R comprised a laminate of 100% of the same ethylene vinyl acetate copolymer bonded to a film of the same isotactic polypropylene. Thermal bonding of Example 17 was 2.81 lbF (12.5N) and less than 0.5 lbsF (<2.23N) for the sample of Comparative Example R, indicating enhance bonding for the blend of Example 17.

Example 18 and Comparative Example S

Film laminates were prepared according to the above Procedure A and evaluated for thermal bonding according to the Procedure B. Example 18 comprised a laminate of (1) 75% ethylene-propylene copolymer ("FINA 95129" material) blended with 25% block copolymer (KRATON G 1657 material) bonded to (2) isotactic polypropylene ("PP 3445" material). Comparative Example S comprised a laminate of 100% of the same ethylene-propylene copolymer bonded to a film of the same isotactic polypropylene. Thermal bonding of Example 18 was 1.21 lbsF (5.4N) and about 0.25 lbsF (about 1.11N) for the sample of Comparative Example S, indicating enhance bonding for the blend of Example 18.

Example 19 and Comparative Example T

Film laminates were prepared according to the above Procedure A and evaluated for thermal bonding according to the Procedure B. Example 19 comprised a laminate of (1) 75% ethylene methyl acrylate copolymer (EMAC SP 2220 material) blended with 25% block copolymer (KRATON G 1657 material). bonded to (2) isotactic polypropylene ("PP 3445" material) Comparative Example T comprised a laminate of 100% of the same ethylene methyl acrylate copolymer bonded to the same isotactic polypropylene. Thermal bonding of Example 19 was 1.6 lbsF (7.1N) and less than 0.5 lbsF (<2.23N) for the sample of Comparative Example T, indicating enhance bonding for the blend of Example 19.

Various alterations and modifications of this invention will become apparent to those skilled in the art without departing from the scope and spirit of this invention.

What is claimed is:

1. Multicomponent filament comprising:

(a) first component comprising synthetic plastic polymer; and (b) second component having a melting point lower than that of the first component, the second component comprising a first synthetic thermoplastic polymer and a second synthetic thermoplastic polymer, the first synthetic thermoplastic polymer comprising a block copolymer of styrene, ethylene and butylene wherein the styrene content is between about 1 to 20% by weight;

the filament being tough and durably melt-bondable in its undrawn state, the first and second components being, along the length of the filament, elongated, contiguous, and coextensive, the second component defining all or at least part of the material-air boundary of the filament.

2. Multicomponent filament according to claim 1, wherein the first and second components are, along the length of the filament, integral and inseparable.

3. Multicomponent filament according to claim 1 in the form of sheath-core bicomponent filament, the core being the first component and the sheath being the second component.

4. Multicomponent filament according to claim 3, wherein the first component is in the form of a plurality of cores of the same composition or different compositions.

5. Multicomponent filament according to claim 3, wherein the core and the sheath are concentric.

6. Multicomponent filament according to claim 3, wherein the core is cellular.

7. Multicomponent filament according to claim 1 in the form of side-by-side filament.

8. Multicomponent filament according to claim 7, wherein the first and second components are side-by-side alternate layers.

9. Multicomponent filament according to claim 1, wherein the second component has a melting point of at least 15° C. below that of the first component.

10. Multicomponent filament according to claim 1 having a linear density greater than 200 denier per filament.

11. Multicomponent filament according to claim 1 having a linear density of 500 to 20,000 denier per filament.

12. Multicomponent filament according to claim 1, wherein the first and second components have tensile strengths greater than or equal to 3.4 MPa, elongation greater than or equal to 100%, work of rupture greater than or equal to $1.9\times10^7$ J/m$^3$ and a flex fatigue resistance greater than 200 cycles to break; and wherein the second component has a melting point greater than 38° C.

13. Multicomponent filament according to claim 1 wherein the first component comprises polypropylene blended with ethylene-propylene-butene copolymer.

14. Multicomponent filament according to claim 1 wherein the second synthetic thermoplastic of the second component comprises material selected from the group consisting of ethylene-propylene copolymer, ethylene vinyl acetate copolymer, ethylene methyl acrylate copolymer and ethyl methacrylate copolymer having a counterion comprising zinc.

15. Multicomponent filament according to claim 1 wherein the first component comprises material selected from the group consisting of nylon 6, ethylene-propylene copolymer and, optionally, a block copolymer of styrene, ethylene and propylene wherein the styrene content is between about 1 to 20% by weight.

16. An abrasive article comprising an open, nonwoven web of the filaments of claim 1, the filaments being durably melt bonded to one another at mutual contact points and further comprising abrasive particulate bonded to the surfaces of the filaments.

17. A filamentary structure comprising at least one central, regularly undulating or spiral sheath-core filament surrounded and bonded to a plurality of straight, parallel sheath-core filaments, the central and straight filaments being according to claim 1.

18. Multicomponent filament comprising:

(a) a central core comprising a synthetic thermoplastic polymer; and (b) a sheath comprising a blend of a block copolymer of styrene, ethylene and butylene wherein the styrene content is between about 1 to 20% by weight and material selected from the group consisting of ethylene-propylene copolymer, ethylene vinyl acetate copolymer, ethylene methyl acrylate copolymer and ethyl methacrylate copolymer having a counterion comprising zinc;

the filament being tough and durably melt-bondable in its undrawn state and having a linear density of 500 to 20,000 denier per filament.

19. Matting comprising:

an open, nonwoven web of thermoplastic, sheath-core bicomponent filaments having a linear density of 500 to 20,000 denier per filament, the filaments being undrawn, tough and durably melt-bonded to one another at mutual contact points, the filaments each comprised of (a) a central core comprising a synthetic plastic polymer; and (b) a sheath comprising a block copolymer of styrene, ethylene and butylene wherein the styrene content is between about 1 to 20% and material selected from the group consisting of ethylene-propylene copolymer, ethylene vinyl acetate copolymer, ethylene methyl acrylate copolymer and ethyl methacrylate copolymer having a counterion comprising zinc.

20. Matting according to claim 19 wherein the filaments are sheath-core filaments, the core being the first component and the sheath being the second component.

21. Matting according to claim 19 wherein a surface of the matting has a slip resistant pattern.

22. Matting according to claim 19 further comprising a laminated backing.

23. Matting according to claim 22 wherein the backing comprises material selected from the group consisting of isotactic polypropylene, ethylene vinyl acetate, ethylene methacrylate with a zinc counterion, ethylene-propylene copolymer and ethylene methyl acrylate copolymer.

24. Matting according to claim 23 wherein the backing further comprises a block copolymer of styrene, ethylene and butylene wherein the styrene content is between about 1 to 20%.

25. Matting according to claim 22 wherein the backing comprises the same material as the sheath.

26. Method of making multicomponent filament of claim 1, which method comprises the continuous steps of simultaneously melt-extruding a molten stream of first component and a molten stream of second component to form a hot, tacky, molten, melt-bondable, thermoplastic, macrodenier, multicomponent filament comprising the first and second components; permitting the hot filament to cool and solidify; and recovering the resulting solidified filament without any substantial tension being placed thereon.

27. The method of claim 26 wherein the step of cooling is carried out by quenching the bundle of hot filaments in a body of liquid.

28. The method of claim 26 wherein a web of the quenched filaments is formed in the body of liquid.

29. The method of claim 28 wherein the web comprises the filaments in helical, interengaged form.

30. The method of claim 28 further comprising heating the web to melt-bond the filaments thereof at points of contact.

31. The method of claim 28 wherein the web is withdrawn from the body of liquid and heated to melt-bond the filaments at their points of contact.

32. The method of claim 28 wherein the filaments of the web are melt-bonded in the body of liquid.

33. The method of claim 28 further comprising embossing a pattern or impression on the web.

34. The method of claim 28 wherein the web is heated to melt the second component of the filament thereof, abrasive particulate is coated on the heated web, and the coated web is cooled to form an abrasive web.

35. The method of claim 28 wherein a thermoplastic backing is laminated to the web.

36. The method of claim 35 wherein the thermoplastic backing is laminated to the web as it is formed in the body of liquid.

37. The method of claim 35 wherein the thermoplastic backing and the web are melt-bonded together in the body of liquid.

38. The method of claim 35 wherein the thermoplastic backing is formed by extrusion thereof simultaneously with the formation of the web.

39. The method of claim 35 wherein the laminate of the web and the backing is embossed.

40. The method according to claim 31 wherein the filaments are in the form of sheath-core bicomponent filaments, the core being the first component and the sheath being the second component.

41. The method of claim 26 wherein the filaments are in the form of side-by-side bicomponent filaments.

42. The method according to claim 26 wherein each of the filaments have a linear density of 500 to 20,000 denier per filament, the first component being a blend of polypropylene and ethylene-propylene-butene copolymer, and the second synthetic thermoplastic polymer of the second component being material selected from the group consisting of ethylene-propylene copolymer, ethylene vinyl acetate copolymer and ethyl methacrylate having a counterion comprising zinc.

* * * * *